US011795776B2

(12) United States Patent
Babbitt et al.

(10) Patent No.: US 11,795,776 B2
(45) Date of Patent: Oct. 24, 2023

(54) MANIFOLDS FOR PROVIDING HYDRAULIC FLUID TO A SUBSEA BLOWOUT PREVENTER AND RELATED METHODS

(71) Applicant: Transocean Innovation Labs Ltd., George Town (KY)

(72) Inventors: Guy Robert Babbitt, Fort Collins, CO (US); James Edward Kersey, Loveland, CO (US); Nicholas Paul Echter, Fort Collins, CO (US); Kristina Weyer-Geigel, Fort Collins, CO (US)

(73) Assignee: TRANSOCEAN INNOVATION LABS LTD, George Town Grand Cayman (KY)

( * ) Notice: Subject to any disclaimer, the term of this patent is extended or adjusted under 35 U.S.C. 154(b) by 0 days.

(21) Appl. No.: 17/220,217

(22) Filed: Apr. 1, 2021

(65) Prior Publication Data

US 2022/0049568 A1 Feb. 17, 2022

Related U.S. Application Data

(63) Continuation of application No. 16/385,558, filed on Apr. 16, 2019, now abandoned, which is a (Continued)

(51) Int. Cl.
*E21B 33/064* (2006.01)
*E21B 34/16* (2006.01)

(52) U.S. Cl.
CPC ..... *E21B 33/064* (2013.01); *E21B 34/16* (2013.01)

(58) Field of Classification Search
CPC ..... E21B 33/064; E21B 34/16
See application file for complete search history.

(56) References Cited

U.S. PATENT DOCUMENTS 3,921,500 A * 11/1975 Silcox ..... E21B 33/0355 91/4 R
4,098,333 A * 7/1978 Wells ..... E21B 43/017 166/352

(Continued)

FOREIGN PATENT DOCUMENTS

CN 101322100 A 12/2008
CN 102226383 A 10/2011

(Continued)

OTHER PUBLICATIONS

International Search Report and Written Opinion in International Application No. PCT/US2014/057926 dated Jan. 2, 2015.

(Continued)

*Primary Examiner* — Aaron L Lembo
(74) *Attorney, Agent, or Firm* — Panitch Schwarze Belisario & Nadel LLP

(57) ABSTRACT

This disclosure includes manifolds, subsea valve modules, and related methods. Some manifolds and/or subsea valve modules include one or more inlets, each configured to receive hydraulic fluid from a fluid source, one or more outlets, each in selective fluid communication with at least one of the inlets, and one or more subsea valve assemblies, each configured to selectively control hydraulic fluid communication from at least one of the inlets to at least one of the outlets, where at least one of the outlets is configured to be in fluid communication with an actuation port of the hydraulically actuated device.

12 Claims, 17 Drawing Sheets

Related U.S. Application Data continuation of application No. 15/496,898, filed on Apr. 25, 2017, now Pat. No. 10,267,116, which is a continuation of application No. 14/499,145, filed on Sep. 27, 2014, now Pat. No. 9,664,005.

(60) Provisional application No. 61/887,728, filed on Oct. 7, 2013, provisional application No. 61/887,825, filed on Oct. 7, 2013, provisional application No. 61/887,698, filed on Oct. 7, 2013.

(56) References Cited

U.S. PATENT DOCUMENTS 4,413,642 A * 11/1983 Smith ..... E21B 34/16 137/102
4,553,600 A 11/1985 Vigouroux et al.
6,032,742 A * 3/2000 Tomlin ..... E21B 33/063 166/345
6,328,070 B2 12/2001 Clayton et al.
7,216,714 B2 * 5/2007 Reynolds ..... E21B 33/035 137/557
8,186,441 B2 5/2012 Donohue et al.
8,393,399 B2 * 3/2013 Judge ..... E21B 33/0355 166/366
8,430,168 B2 * 4/2013 Goodall ..... F16L 1/26 166/336
8,464,797 B2 * 6/2013 Singh ..... E21B 33/0385 166/340
8,485,260 B2 7/2013 Donohue et al.
8,490,705 B2 * 7/2013 Curtiss, III ..... E21B 34/16 166/368
8,607,879 B2 12/2013 Reynolds
8,640,775 B2 * 2/2014 Kotrla ..... E21B 33/064 166/338
8,684,092 B2 * 4/2014 McGrath ..... E21B 33/06 166/368
8,733,090 B2 * 5/2014 Coonrod ..... E21B 33/0355 60/485
8,781,743 B2 * 7/2014 McKay ..... E21B 41/0007 702/6
8,843,328 B2 9/2014 Curtiss, III
9,115,563 B2 * 8/2015 Kotrla ..... E21B 33/064
2001/0003288 A1 * 6/2001 Clayton ..... F16K 27/003 137/884
2005/0039923 A1 * 2/2005 Howe ..... E21B 33/0355 166/368
2009/0101350 A1 * 4/2009 O'leary ..... E21B 33/0355 166/344
2010/0084588 A1 * 4/2010 Curtiss, III ..... E21B 34/16 251/57
2011/0266003 A1 * 11/2011 Singh ..... E21B 33/064 166/368
2012/0043089 A1 * 2/2012 Hoffman ..... E21B 33/076 166/340
2012/0055679 A1 * 3/2012 Van Winkle ..... E21B 33/0355 166/363
2012/0197527 A1 8/2012 McKay et al.
2012/0318529 A1 * 12/2012 Herrold ..... E21B 43/01 166/375
2013/0022401 A1 * 1/2013 Magowan ..... E21B 43/0122 405/60
2013/0175041 A1 * 7/2013 Nellessen, Jr. ..... E21B 33/0355 166/336
2015/0114660 A1 * 4/2015 Kotrla ..... F16L 41/021 166/363

FOREIGN PATENT DOCUMENTS

CN 202273627 U 6/2012
CN 103161425 A 6/2013
WO 2008074995 A1 6/2008
WO 2012149202 A2 11/2012

OTHER PUBLICATIONS

Office Action dated Jan. 19, 2022 in Chinese Application No. 202010672685.
Office Action issued in Australian application No. 2014332388, dated Jan. 19, 2018.
Office Action issued in Chinese Patent Application No. 201480066908.0, dated Mar. 13, 2018.
Supplemental Search Report issued in European Patent Application No. 14851653.7, dated Sep. 6, 2017.
Written Opinion and Search Report issued in Singaporean Patent Application No. 11201602684R, dated Aug. 11, 2017.
Second Office Action issued in Chinese Patent Application No. 201480066908.0, dated Nov. 28, 2018, 5 pages Non-English and 3 pages. English translation.
Examination Report No. 3 issued by the Australian Patent Office for Application No. 2014332388, dated Jan. 10, 2019, 4 pages.

* cited by examiner

MANIFOLDS FOR PROVIDING HYDRAULIC FLUID TO A SUBSEA BLOWOUT PREVENTER AND RELATED METHODS

CROSS-REFERENCE TO RELATED APPLICATIONS

This application is a continuation of U.S. patent application Ser. No. 16/385,558, filed Apr. 16, 2019, entitled "Manifolds for Providing Hydraulic Fluid to a Subsea Blowout Preventer and Related Methods," which is a continuation of U.S. patent application Ser. No. 15/496,898, filed Apr. 25, 2017, entitled "Manifolds for Providing Hydraulic Fluid to a Subsea Blowout Preventer and Related Methods," now U.S. Pat. No. 10,267,116 which is a continuation of U.S. application Ser. No. 14/499,145, filed on Sep. 27, 2014, now U.S. Pat. No. 9,664,005, and entitled "Manifolds for Providing Hydraulic Fluid to a Subsea Blowout Preventer and Related Methods," which claims priority to: (1) U.S. Provisional Application No. 61/887,825, filed on Oct. 7, 2013 and entitled "Bi-Stable Control Valves for Subsea Applications;" (2) U.S. Provisional Application No. 61/887,728, filed on Oct. 7, 2013 and entitled "Integrated Pilot and Main Stage Valves for Use in Subsea Applications;" and (3) U.S. Provisional Application No. 61/887,698, filed on Oct. 7, 2013 and entitled "Integrated Actuation and Instrumentation of Valves in Subsea Applications." Each of the foregoing patent applications is incorporated by reference in its entirety.

BACKGROUND

1. Field of Invention

The present invention relates generally to subsea blowout preventers, and more specifically, but not by way of limitation, to manifolds configured to, for example, provide hydraulic fluid to a hydraulically actuated device of a subsea blowout preventer.

2. Description of Related Art

A blowout preventer is a mechanical device, usually installed redundantly in stacks, used to seal, control, and/or monitor oil and gas wells. Typically, a blowout preventer includes a number of devices, such as, for example, rams, annulars, accumulators, test valves, failsafe valves, kill and/or choke lines and/or valves, riser joints, hydraulic connectors, and/or the like, many of which may be hydraulically actuated.

Current systems for providing hydraulic fluid to such blowout preventer devices may contain single point of failure components that can render one or more blowout preventer devices partially or completely inoperable upon failure of the component.

Such current systems may also require relatively complex, time-intensive, and costly repairs and/or replacements of malfunctioning components, in some cases, necessitating replacement of large assemblies of components, many of which may be otherwise functional. And, in some instances, such repairs and/or replacements may require cessation of well operations.

Current systems for providing hydraulic fluid to such blowout preventer devices may also not be configured to provide hydraulic fluid from redundant pressure sources.

Examples of manifolds are disclosed in U.S. Patents: (1) U.S. Pat. No. 7,216,714; (2) U.S. Pat. No. 6,032,742; (3) U.S. Pat. No. 8,464,797; and (4) U.S. Pat. No. 8,393,399.

SUMMARY

Some embodiments of the present manifolds are configured (via at least two inlets each configured to receive hydraulic fluid from a respective fluid source and via at least one outlet selectively in simultaneous fluid communication with the at least two inlets) to provide hydraulic fluid to a hydraulically actuated device of a blowout preventer simultaneously from at least two independent fluid sources.

Some embodiments of the present manifolds are configured (via at least one inlet, at least one outlet, a first two-way valve configured to selectively allow fluid communication from the at least one inlet to the at least one outlet, and a second two-way valve configured to selectively divert hydraulic fluid from the at least one outlet to at least one of a reservoir and a subsea environment) to provide (1) for a fault tolerant hydraulic architecture (e.g., by eliminating single point of failure components, utilizing relatively uncomplicated and/or failsafe valves, and/or the like); (2) for hydraulic isolation of at least a portion of the manifold from the fluid source-manifold-hydraulically actuated device hydraulic system, for example, in the event of a valve and/or other component failure (e.g., to prevent undesired operation and/or non-operation of the hydraulically actuated device and/or excessive hydraulic fluid loss), to facilitate removal of the manifold from the hydraulically actuated device and/or a portion of the manifold from the manifold (e.g., to repair and/or replace the manifold, a portion of the manifold, and/or a component thereof, in some instances, without otherwise interrupting hydraulically actuated device operation), and/or the like; (3) and/or the like. Some embodiments of the present manifolds are configured to achieve such desirable functionality through one or more isolation valves, which, for example, may be configured to automatically block fluid communication through at least a portion of the manifold, for example, upon removal of the manifold from the hydraulically actuated device, a portion of the manifold from the manifold, a fluid source from the manifold, upon a command send to the one or more isolation valves, and/or the like.

Some embodiments of the present manifolds are configured (through a subsea valve module having one or more inlets and at least two outlets, the subsea valve module configured to allow each outlet to be in simultaneous fluid communication with a same one of the inlets) to facilitate the coupling and/or decoupling of additional subsea valve modules and/or other components to the subsea valve module (e.g., via a coupling to one or more of the at least two outlets of the subsea valve module) (e.g., to facilitate repair and/or replacement of the manifold, a portion of the manifold, and/or components of the manifold, assembly of the manifold, and/or the like).

Some embodiments of the present manifolds are configured, through one or more sensors configured to capture data indicative of hydraulic operation of the manifold and/or a hydraulically actuated device of a blowout preventer, and a processor, configured to control, based at least in part on the data captured by the sensors, actuation of a component of the manifold (e.g., a valve), to provide for autonomous, standalone, and/or closed loop manifold and/or hydraulically actuated device operation.

Some embodiments of the present manifolds for providing hydraulic fluid to a hydraulically actuated device of a blowout preventer comprise at least two inlets, each configured to receive hydraulic fluid from a fluid source, one or more outlets, the manifold configured to allow each outlet to be in simultaneous fluid communication with at least two of the inlets, and one or more subsea valve assemblies, each configured to selectively control hydraulic fluid communication from at least one of the inlets to at least one of the one or more outlets, where at least one of the one or more outlets is configured to be in fluid communication with an actuation port of the hydraulically actuated device. In some embodiments, at least two of the inlets are each configured to receive hydraulic fluid from a respective fluid source.

In some embodiments, at least one of the one or more subsea valve assemblies comprises one or more isolation valves configured to selectively block fluid communication through at least one of the inlets. In some embodiments, at least one of the one or more isolation valves is configured to automatically block fluid communication through at least one of the inlets upon decoupling of the fluid source from the inlet.

In some embodiments, at least one of the one or more subsea valve assemblies comprises one or more isolation valves configured to selectively block fluid communication through at least one of the one or more outlets. In some embodiments, at least one of the one or more isolation valves is configured to automatically block fluid communication through at least one of the one or more outlets upon decoupling of the outlet from the actuation port of the hydraulically actuated device.

Some embodiments of the present manifolds for providing hydraulic fluid to a hydraulically actuated device of a blowout preventer comprise a first subsea valve module comprising one or more inlets, each configured to receive hydraulic fluid from a fluid source, at least two outlets, the subsea valve module configured to allow each outlet to be in simultaneous fluid communication with a same one of the one or more inlets, and one or more subsea valve assemblies, each configured to selectively control hydraulic fluid communication from at least one of the one or more inlets to at least one of the outlets, where a first one of the outlets is configured to be in fluid communication with an actuation port of the hydraulically actuated device, and a second one of the outlets is configured to be in fluid communication with an outlet of a second subsea valve module.

Some embodiments of the present manifolds for providing hydraulic fluid to a hydraulically actuated device of a blowout preventer comprise first and second subsea valve modules, each comprising one or more inlets, each configured to receive hydraulic fluid from a fluid source, one or more outlets, each in selective fluid communication with at least one of the one or more inlets, and one or more subsea valve assemblies, each configured to selectively control hydraulic fluid communication from at least one of the one or more inlets to at least one of the one or more outlets, where at least one of the one or more outlets of the first subsea valve module is configured to be in simultaneous fluid communication with at least one of the one or more outlets of the second subsea valve module and an actuation port of the hydraulically actuated device.

Some embodiments of the present manifolds for providing hydraulic fluid to a hydraulically actuated device of a blowout preventer comprise first, second, and third subsea valve modules, each comprising one or more inlets, each configured to receive hydraulic fluid from a fluid source, one or more outlets, each in selectively fluid communication with at least one of the one or more inlets, and one or more subsea valve assemblies, each configured to selectively control hydraulic fluid communication from at least one of the one or more inlets to at least one of the one or more outlets, where at least one of the one or more outlets of the first subsea valve module is configured to be in simultaneous fluid communication with at least one of the one or more outlets of the second subsea valve module, at least one of the one or more outlets of the third subsea valve module, and an actuation port of the hydraulically actuated device.

In some embodiments, at least one of the subsea valve modules is configured to be coupled to at least one other of the subsea valve modules. In some embodiments, at least two of the subsea valve modules define one or more conduits when the at least two of the subsea valve modules are coupled together, the one or more conduits each in fluid communication with at least one of the outlet(s) of each of the at least two subsea valve modules and configured to communicate hydraulic fluid to a respective actuation port of the hydraulically actuated device. "Outlet(s)" may mean "outlet" when it refers "one or more outlets," and may mean "outlets" when it refers to "two or more outlets."

In some embodiments, at least two of the subsea valve modules are configured to receive hydraulic fluid from respective fluid sources. In some embodiments, each of the subsea valve modules is configured to receive hydraulic fluid from a respective fluid source.

In some embodiments, at least one of the subsea valve modules comprises one or more isolation valves configured to selectively block fluid communication through at least one of the one or more inlets. In some embodiments, at least one of the one or more isolation valves is configured to automatically block fluid communication through at least one of the one or more inlets upon decoupling of the fluid source from the subsea valve module. In some embodiments, at least one of the subsea valve modules comprises one or more isolation valves configured to selectively block fluid communication through at least one of the outlet(s). In some embodiments, at least one of the one or more isolation valves is configured to automatically block fluid communication through at least one of the outlet(s) upon decoupling of another of the subsea valve modules from the subsea valve module.

Some embodiments of the present manifolds for providing hydraulic fluid to a hydraulically actuated device of a blowout preventer comprise one or more inlets, each configured to receive hydraulic fluid from a fluid source, one or more outlets, each in selective fluid communication with at least one of the one or more inlets, and one or more subsea valve assemblies, each configured to selectively control hydraulic fluid communication from at least one of the one or more inlets to at least one of the one or more outlets, where at least one of the one or more outlets is configured to be in fluid communication with an actuation port of the hydraulically actuated device. In some embodiments, the manifold is configured to allow each outlet to be in simultaneous fluid communication with at least two of the inlets.

In some embodiments, at least one of the one or more subsea valve assemblies comprises a first two-way valve configured to selectively allow fluid communication from at least one of the one or more inlets to at least one of the outlet(s), and a second two-way valve configured to selectively divert hydraulic fluid from at least one of the outlet(s) to at least one of a reservoir and a subsea environment.

In some embodiments, at least one of the one or more subsea valve assemblies comprises one or more isolation valves, each configured to selectively block fluid communication through at least one of: at least one of the one or more inlets and at least one of the one or more outlets. In some embodiments, at least one of the one or more isolation valves is configured to automatically block fluid communication through at least one of: at least one of the one or more inlets and at least one of the one or more outlets, upon decoupling of at least one of: at least one of the one or more outlets from the actuation port of the hydraulically actuated device and at least one of the one or more inlets from the fluid source.

Some embodiments comprise one or more sensors configured to capture data indicative of at least one of hydraulic fluid pressure, temperature, and flow rate. Some embodiments comprise a processor configured to control actuation of at least one of the subsea valve assemblies. In some embodiments, the processor is configured to control, based at least in part on the data captured by the one or more sensors, actuation of at least one of the one or more subsea valve assemblies.

In some embodiments, at least one of the one or more subsea valve assemblies comprises a three-way valve configured to selectively allow fluid communication from at least one of the inlet(s) to at least one of the outlet(s), and selectively divert hydraulic fluid from at least one of the outlet(s) to at least one of a reservoir and a subsea environment. "Inlet(s)" may mean "inlet" when it refers "one or more inlets," and may mean "inlets" when it refers to "two or more inlets."

In some embodiments, at least one of the one or more subsea valve assemblies comprises a hydraulically actuated main stage valve. In some embodiments, at least one of the one or more subsea valve assemblies comprises a pilot stage valve configured to actuate the main stage valve. In some embodiments, the pilot stage valve is integrated with the main stage valve. Some embodiments comprise a pressure-compensated housing configured to contain the pilot stage valve. In some embodiments, at least one of the one or more subsea valve assemblies comprises a bi-stable valve.

In some embodiments, at least one of the one or more subsea valve assemblies comprises a normally open valve. In some embodiments, at least one of the one or more subsea valve assemblies comprises a normally closed valve. In some embodiments, at least one of the one or more subsea valve assemblies comprises a regulator. In some embodiments, at least one of the one or more subsea valve assemblies comprises an accumulator.

In some embodiments, at least one fluid source comprises a subsea pump. In some embodiments, at least one fluid source comprises a rigid conduit. In some embodiments, the manifold does not comprise a shuttle valve. In some embodiments, at least one of the outlet(s) is in direct fluid communication with the actuation port of the hydraulically actuated device. In some embodiments, the manifold is coupled to the blowout preventer.

Some embodiments comprise a control circuit configured to communicate control signals to at least one of the subsea valve assemblies. In some embodiments, the control circuit comprises a wireless receiver configured to receive control signals. In some embodiments, the control circuit is configured to receive control signals via a wired connection. In some embodiments, at least a portion of the control circuit is disposed within a pressure-compensated housing. In some embodiments, at least a portion of the control circuit is disposed within a composite housing.

Some embodiments comprise one or more electrical connectors in electrical communication with at least one of the one or more subsea valve assemblies. In some embodiments, at least one of the one or more electrical connectors is configured to be coupled to an auxiliary cable. In some embodiments, at least one of the one or more electrical connectors is configured to be in electrical communication with a low marine riser package (LMRP). In some embodiments, at least one of the one or more electrical connectors comprises an inductive coupler.

Some embodiments comprise one or more batteries in electrical communication with at least one of the one or more subsea valve assemblies. In some embodiments, the manifold is configured to be removable from a blowout preventer via manipulation by a remotely operated underwater vehicle (ROV).

Some embodiments of the present manifold assemblies comprise a plurality of the present manifolds. In some embodiments, at least two of the manifolds are in electrical communication with one another via one or more dry-mate electrical connectors.

Some embodiments of the present methods for providing hydraulic fluid to a hydraulically actuated device of a blowout preventer comprise coupling at least a first fluid source and a second fluid source into fluid communication with an actuation port of the hydraulically actuated device. Some embodiments comprise coupling the first fluid source to a first inlet of a manifold having an outlet in fluid communication with the first inlet and the hydraulically actuated device and coupling the second fluid source to a second inlet of the manifold, the second inlet in fluid communication with the outlet. Some embodiments comprise coupling a third fluid source into fluid communication with the actuation port of the hydraulically actuated device. Some embodiments comprise coupling a third fluid source to a third inlet of the manifold, the third inlet in fluid communication with the outlet.

Some embodiments comprise providing hydraulic fluid to the hydraulically actuated device simultaneously from at least the first fluid source and the second fluid source. Some embodiments comprise providing hydraulic fluid the hydraulically actuated device simultaneously from the first fluid source, the second fluid source, and the third fluid source. Some embodiments comprise adjusting a pressure of at least one fluid source to a higher pressure than a pressure of at least one other fluid source. Some embodiments comprise providing hydraulic fluid to the hydraulically actuated device from at least one fluid source before providing hydraulic fluid to the hydraulically actuated device from at least one other fluid source.

Some embodiments of the present methods for removing a manifold from a hydraulically actuated device of a blowout preventer, the manifold coupled to and in fluid communication with the hydraulically actuated device, comprise decoupling the manifold from the hydraulically actuated device and causing actuation of one or more isolation valves of the manifold to block fluid communication of sea water into at least a portion of the manifold. In some embodiments, at least one of the isolation valves actuated automatically upon decoupling of the manifold from the hydraulically actuated device.

Some embodiments of the present methods for removing a subsea valve module from a manifold, the manifold coupled to and in fluid communication with a hydraulically actuated device of a blowout preventer, and the subsea valve module coupled to and in fluid communication with the manifold, comprise decoupling the subsea valve module from the manifold and causing actuation of one or more isolation valves of the manifold to block fluid communication of sea water into at least a portion of the manifold. Some embodiments comprise causing actuation of one or more isolation valves of the subsea valve module to block fluid communication of sea water into at least a portion of the subsea valve module. In some embodiments, at least one of the one or more isolation valves actuates automatically upon decoupling of the subsea valve module from the manifold.

In some embodiments, causing actuation of at least one of the one or more isolation valves comprises communicating an electrical signal to the at least one isolation valve.

Some embodiments of the present methods for providing hydraulic fluid to a hydraulically actuated device of a blowout preventer comprise coupling a first outlet of a first subsea valve module to an actuation port of the hydraulically actuated device and coupling a first outlet of a second subsea valve module to a second outlet of the first subsea valve module, each subsea valve module having an inlet configured to receive hydraulic fluid from a fluid source and configured to allow simultaneous fluid communication between the inlet and each of the outlets. Some embodiments comprise coupling a first outlet of a third subsea valve module to a second outlet of the second subsea valve module. Some embodiments comprise, for each valve module, coupling a respective fluid source to the inlet.

Some embodiments of the present methods for controlling hydraulic fluid flow between a hydraulically actuated device of a blowout preventer and a fluid source comprise actuating a first two-way valve of a manifold coupled in fluid communication with and between the hydraulically actuated device and the fluid source to selectively allow fluid communication between the fluid source and the hydraulically actuated device, and actuating a second two-way valve of the manifold to selectively divert hydraulic fluid from at least one of the fluid source and the hydraulically actuated device to at least one of a reservoir and a subsea environment.

Some embodiments comprise actuating the first and second two-way valves such that both the first and second two way valves are closed, and after both the first and second two-way valves are closed, actuating one of the first or second two-way valves such that the one of the first or second two-way valves is opened. Some embodiments comprise actuating the second two-way valve such that the second two-way valve is open, after the second two-way valve is open, actuating the first two-way valve such that the first two-way valve is open such that hydraulic fluid from the fluid source is diverted to at least one of a reservoir and a subsea environment, and after both the first and second two-way valves are opened, actuating the second two-way valve such that the second two-way valve is closed such that hydraulic fluid form the fluid source is directed to the hydraulically actuated device.

Some embodiments comprise actuating an isolation valve in fluid communication between the fluid source and the first two-way valve to selectively block fluid communication between the fluid source and the first two-way valve. Some embodiments comprise actuating an isolation valve in fluid communication between the at least one of the reservoir and the subsea environment and the second two-way valve to selectively block fluid communication between the second two-way valve and the at least one of the reservoir and the subsea environment.

Some embodiments of the present methods for controlling hydraulic fluid flow between a hydraulically actuated device of a blowout preventer and at least two fluid sources comprise actuating a first valve assembly of a manifold to allow communication of hydraulic fluid from a first fluid source to an outlet of the manifold, the outlet in fluid communication with an actuation port of the hydraulically actuated device, monitoring, with a processor, hydraulic fluid pressure at the outlet, and actuating a second valve assembly of the manifold to allow communication of hydraulic fluid from a second fluid source to the outlet if hydraulic fluid pressure at the outlet is below a threshold. Some embodiments comprise actuating an isolation valve of the manifold to block communication of hydraulic fluid from the first fluid source to the outlet of the manifold if hydraulic fluid pressure at the outlet is below a threshold.

Some embodiments of the present methods for controlling hydraulic fluid flow between a hydraulically actuated device of a blowout preventer and a fluid source comprise monitoring, with a processor, a first data set indicative of flow rate through an inlet of a manifold, the first data set captured by a first sensor, the manifold in fluid communication with and between the fluid source and the hydraulically actuated device, monitoring, with the processor, a second data set indicative of flow rate through an outlet of the manifold, the second data set captured by a second sensor, comparing, with the processor, the first data set and the second data set to determine an amount of hydraulic fluid loss within the manifold, and actuating an isolation valve of the manifold to block fluid communication through at least a portion of the manifold if the amount of hydraulic fluid loss exceeds a threshold.

As used in this disclosure, the term "blowout preventer" includes, but is not limited to, a single blowout preventer, as well as a blowout preventer assembly that may include more than one blowout preventer (e.g., a blowout preventer stack).

Hydraulic fluids of and/or suitable for use in the present manifolds can comprise any suitable fluid, such as, for example, sea water, desalinated water, treated water, an oil-based fluid, mixtures thereof, and/or the like.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially" and "approximately" may be substituted with "within [a percentage] of" what is specified, where the percentage includes 0.1, 1, 5, and 10 percent.

Further, a device or system (or component of either) that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION OF ILLUSTRATIVE EMBODIMENTS

Figure 1A:
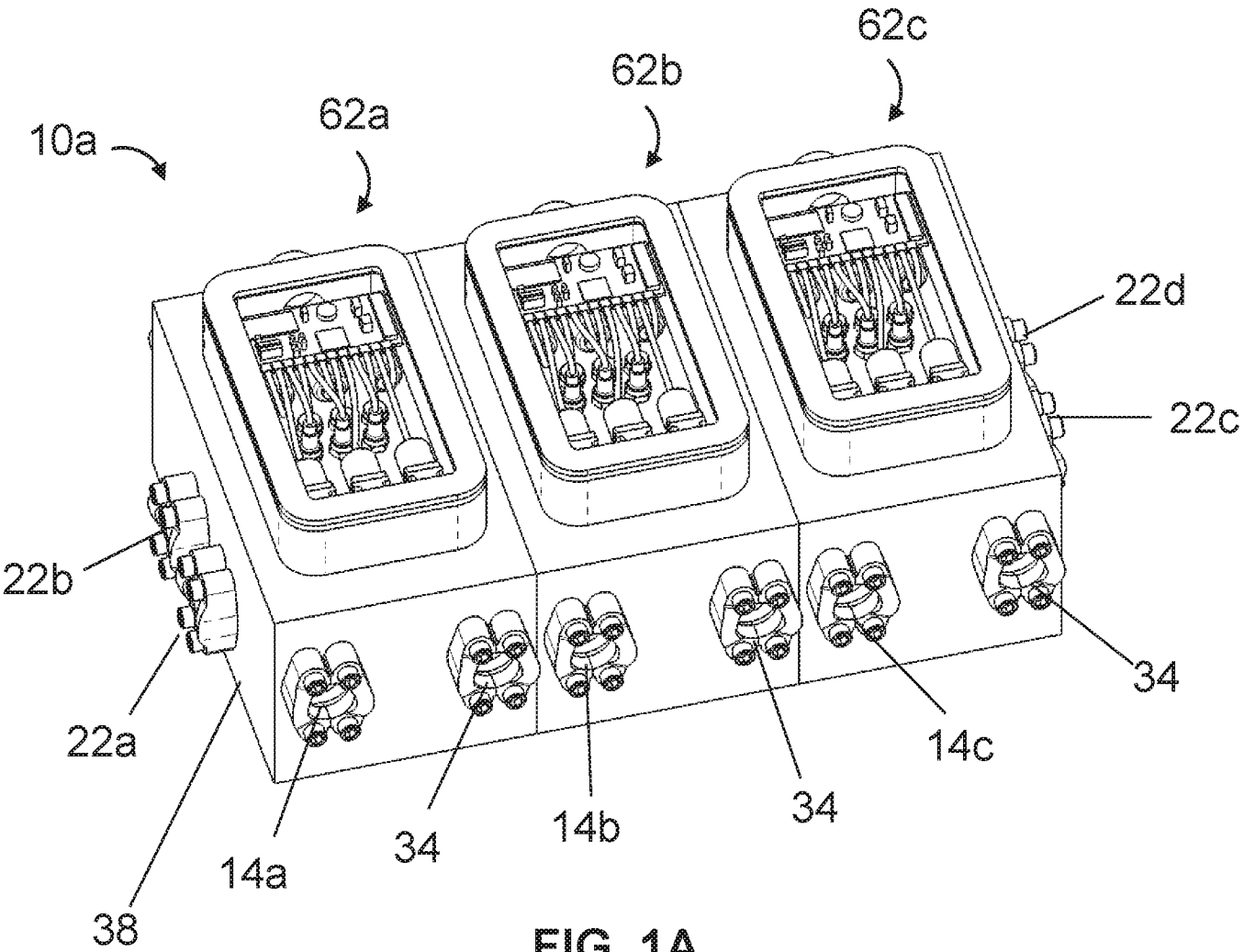
FIG. 1A is a top perspective view of a first embodiment of the present manifolds.
Figure 1B:
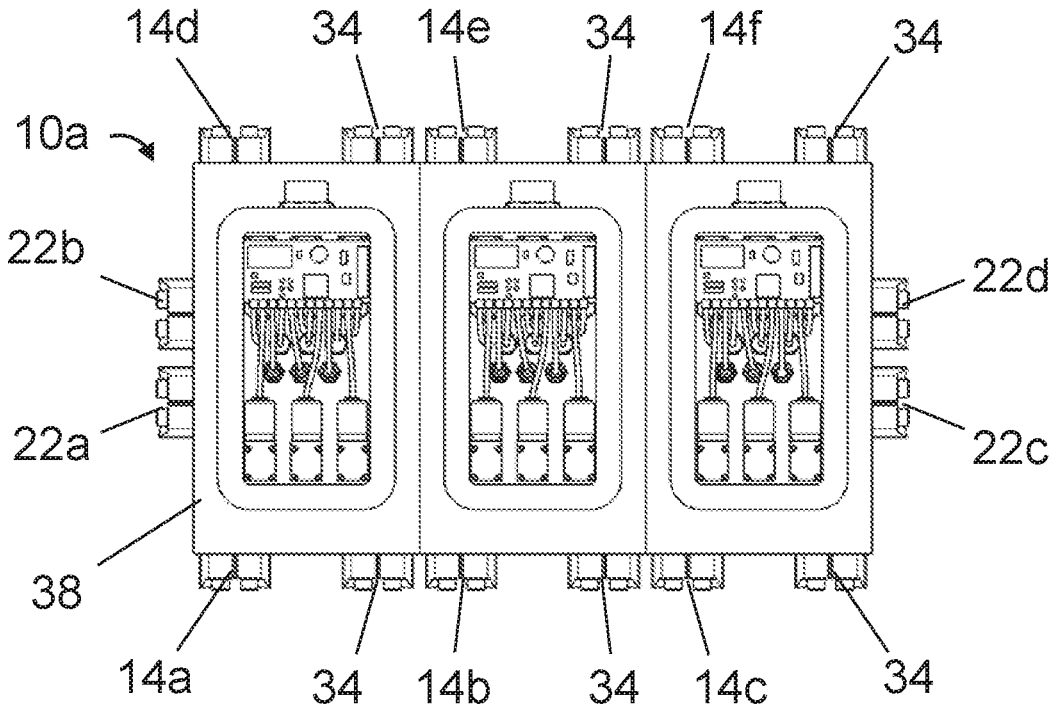
FIGS. 1B and 1C are top and bottom views, respectively, of the manifold of FIG. 1A.
Figure 1C:
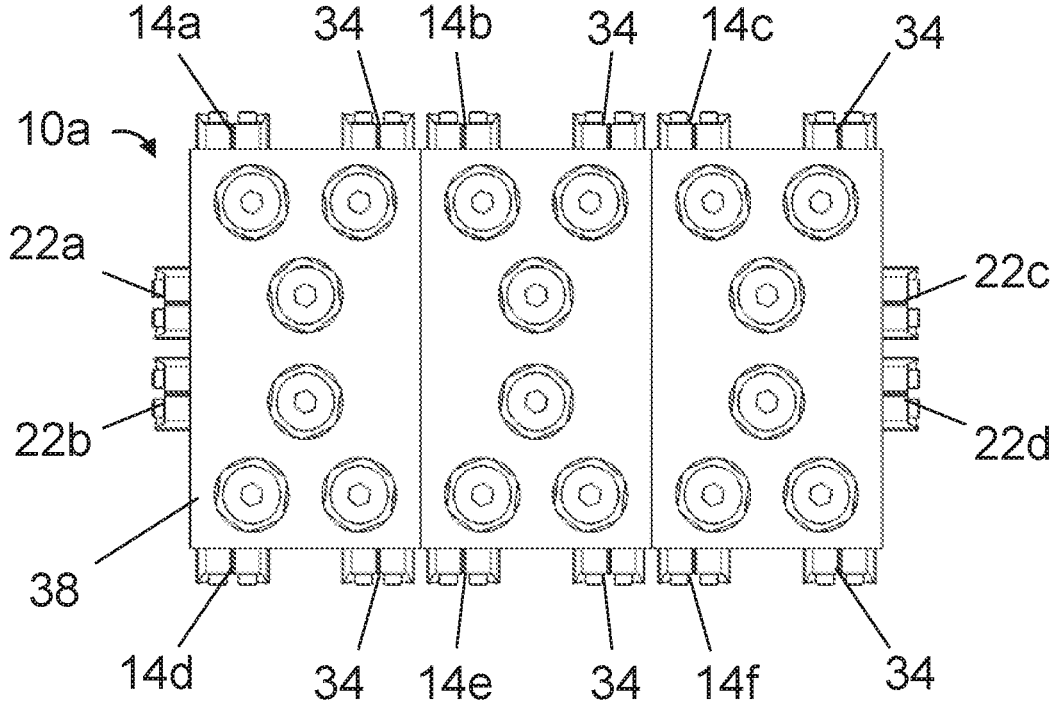
Figure 1D:
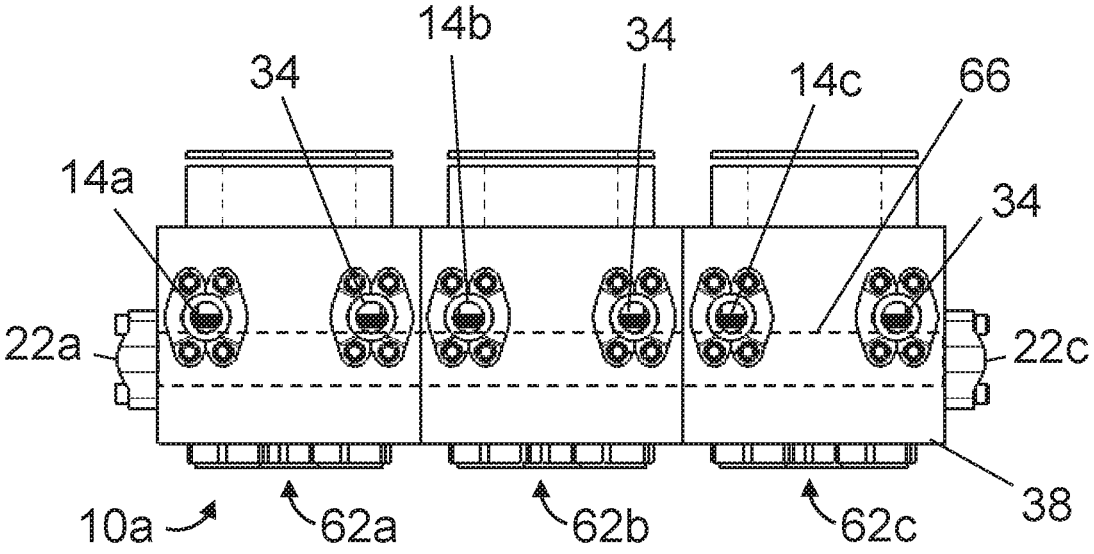
FIGS. 1D and 1E are opposing side views of the manifold of FIG. 1A.
Figure 1E:
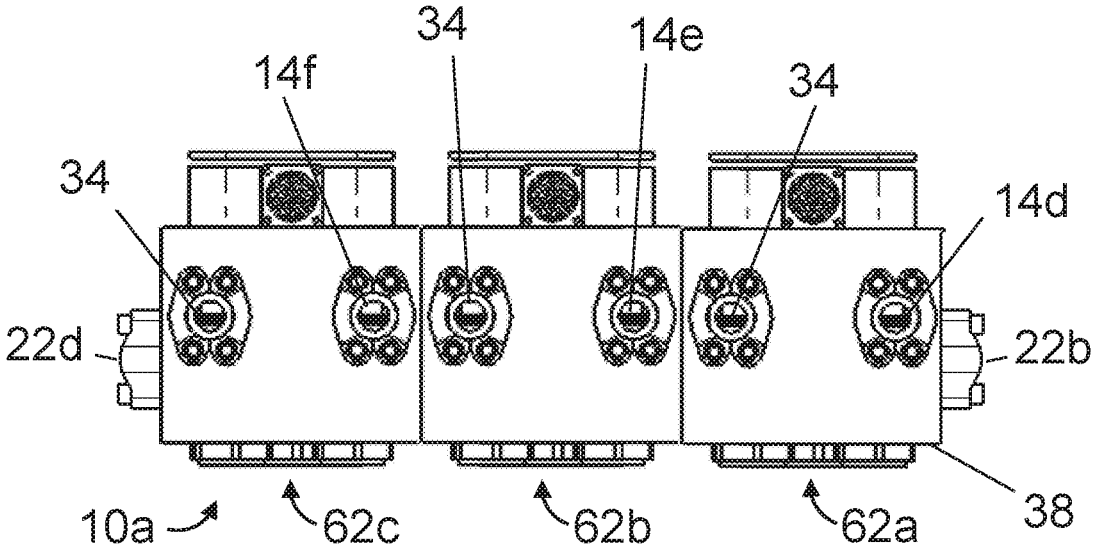
Figure 1F:
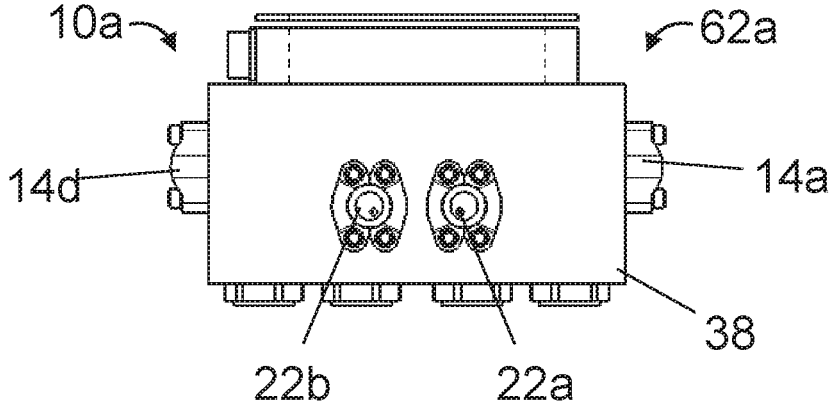
FIGS. 1F and 1G are opposing end views of the manifold of FIG. 1A.
Figure 1G:
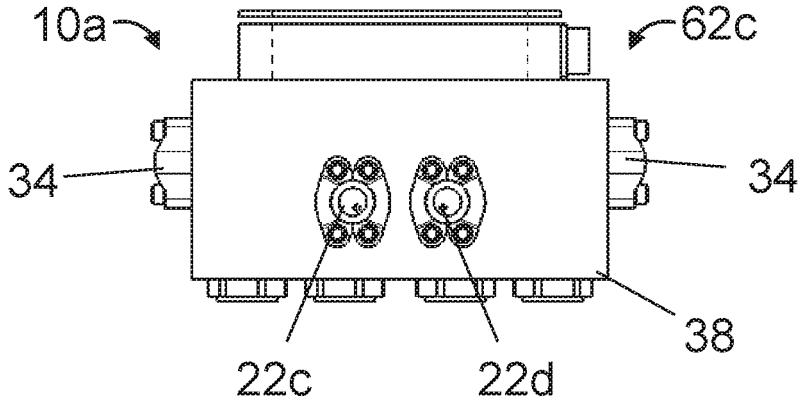
Figure 1H:
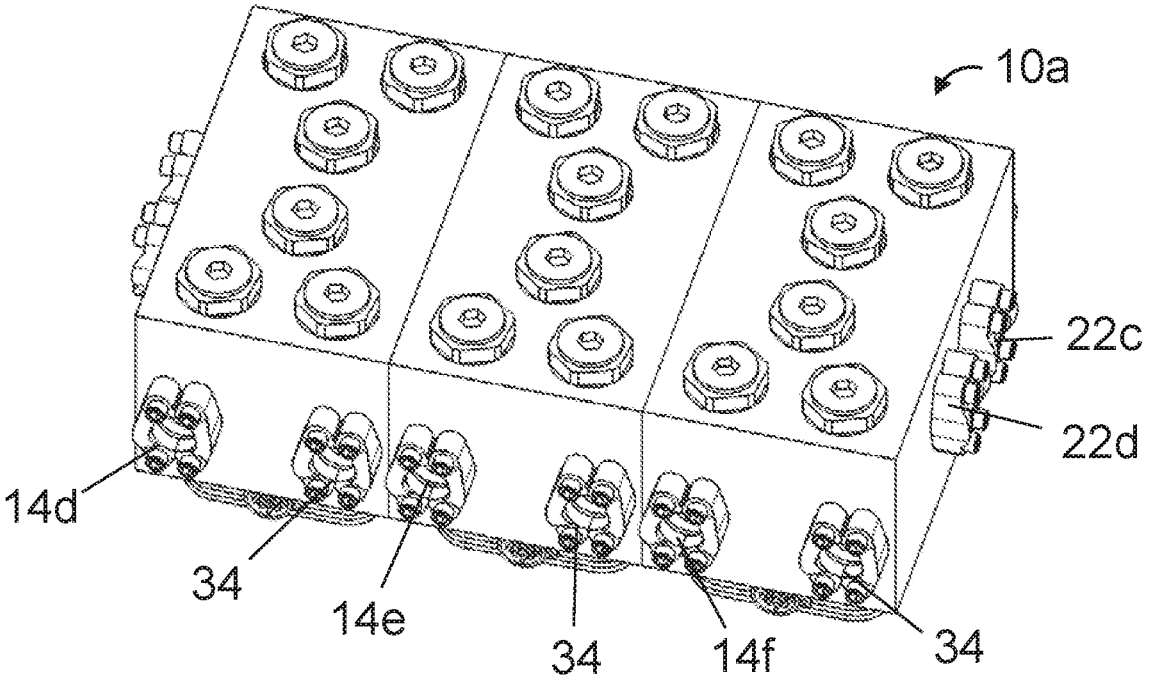
FIG. 1H is a bottom perspective view of the manifold of FIG. 1A.

Referring now to the drawings, and more particularly to FIGS. 1A-1H and 2A-2C, shown therein and designated by the reference numeral 10*a* is a first embodiment of the present manifolds. In the embodiment shown, manifold 10*a* comprises at least two inlets (e.g., 14*a* and 14*b*) (e.g., six (6) inlets, as shown), sometimes referred to collectively as "inlets 14," each configured to receive hydraulic fluid from a fluid source (e.g., 18*a* and/or 18*b*) (described in more detail below). As used in this disclosure, an "inlet" of a manifold refers to a structure of the manifold configured to receive hydraulic fluid from a fluid source such that the manifold can convey the hydraulic fluid to a hydraulically actuated device of a blowout preventer.

In this embodiment, as shown, at least two inlets 14 are configured to receive hydraulic fluid from respective (e.g., separate) fluid sources. As used in this disclosure, a fluid source includes, but is not limited to, a pressure source, and a pressure source may include a flow source. For example, two separate fluid sources may or may not comprise and/or communicate a shared portion of hydraulic fluid; however, pressure provided by the two separate fluid sources is created by individual pressure sources (e.g., that are capable of generating pressure independently of one another). Manifolds of the present disclosure can be configured to receive hydraulic fluid from any suitable fluid source(s), such as, for example, subsea pumps, above-sea pumps, rigid conduits, hotlines, accumulators, reservoirs, and/or the like. Examples of subsea pumps suitable for use with some embodiments of the present manifolds are disclosed in co-pending U.S. patent application Ser. No. 14/461,342, filed on Aug. 15, 2014 and entitled "SUBSEA PUMPING APPARATUSES AND RELATED METHODS," which is hereby incorporated by reference in its entirety.

Figure 3A:
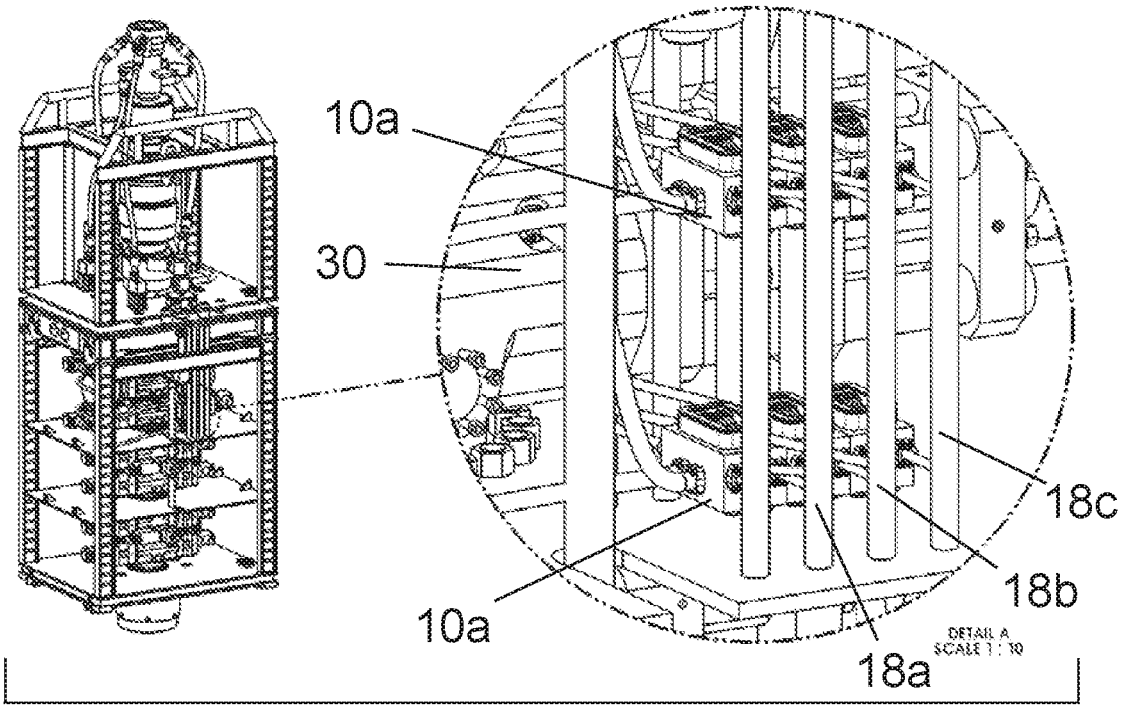
FIGS. 3A and 3B are two perspective views of the manifold of FIG. 1A, shown coupled to a hydraulically actuated device of a blowout preventer.
Figure 3B:
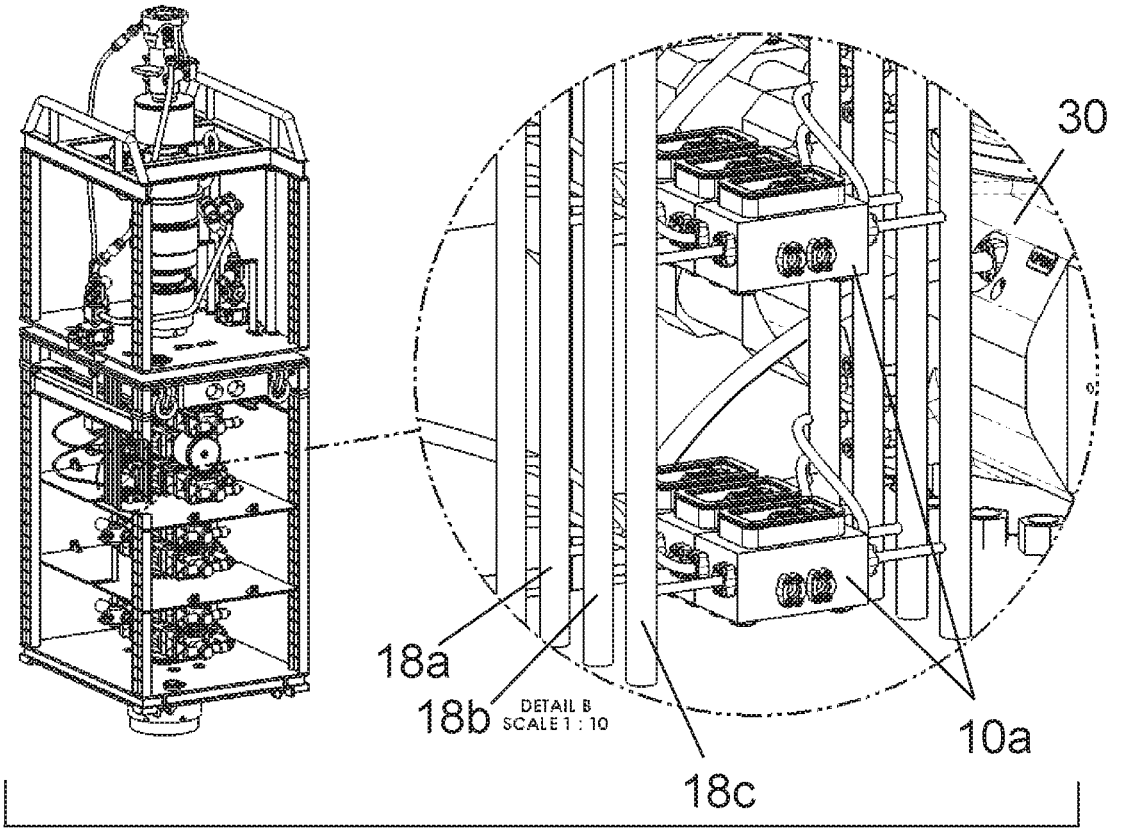

In the embodiment shown, manifold 10*a* comprises one or more outlets (e.g., 22*a*) (e.g., four (4) outlets, as shown), sometimes referred to collectively as "outlets 22." In this embodiment, each of outlets 22 is configured to be in fluid communication with an actuation port of a hydraulically actuated device 30 (FIGS. 3A and 3B). The present manifolds can be used to provide hydraulic fluid to any suitable hydraulically actuated device(s), such as, for example, rams, annulars, accumulators, test valves, failsafe valves, kill and/or choke lines and/or valves, riser joints, hydraulic connectors, and/or the like. As shown in FIGS. 3A and 3B, in this embodiment, manifold 10*a* is configured to be coupled to and in fluid communication with hydraulically actuated device 30 via a coupling structure, such as, for example, valves, hoses, pipes, tubes, conduits, wires, and/or the like (whether rigid or flexible), either electrically hydraulically, mechanically, and/or the like. However, in other embodiments, the present manifolds may be directly coupled to and in fluid communication with a hydraulically actuated device (e.g., 30).

Inlets 14, outlets 22, vents 34 (described in more detail below), and/or the like of the present manifolds can comprise any suitable connectors for receiving or providing hydraulic fluid, such as, for example, connectors configured to mate through interlocking features (e.g., via nipples, wedges, quick-disconnect couplers, and/or the like), face-sealing components, hydraulic stabs (e.g., whether configured as a single- or multiple-stab), stingers, and/or the like.

Any portion of inlets 14, outlets 22, vents 34, associated fluid passageways and/or conduits, and/or the like, can be defined by and within a body or housing 38 of the manifold (e.g., as if by machining) and/or comprise hoses, pipes, tubes, conduits, and/or the like (whether rigid or flexible) (e.g., disposed within body or housing 38). However, in other embodiments, body or housing 38 may be omitted, and pipes, tubes, conduits, components (e.g., valves, and/or the like), component housings, and/or the like of the manifold can function to locate and/or secure components relative to one another within the manifold assembly.

Figure 2A:
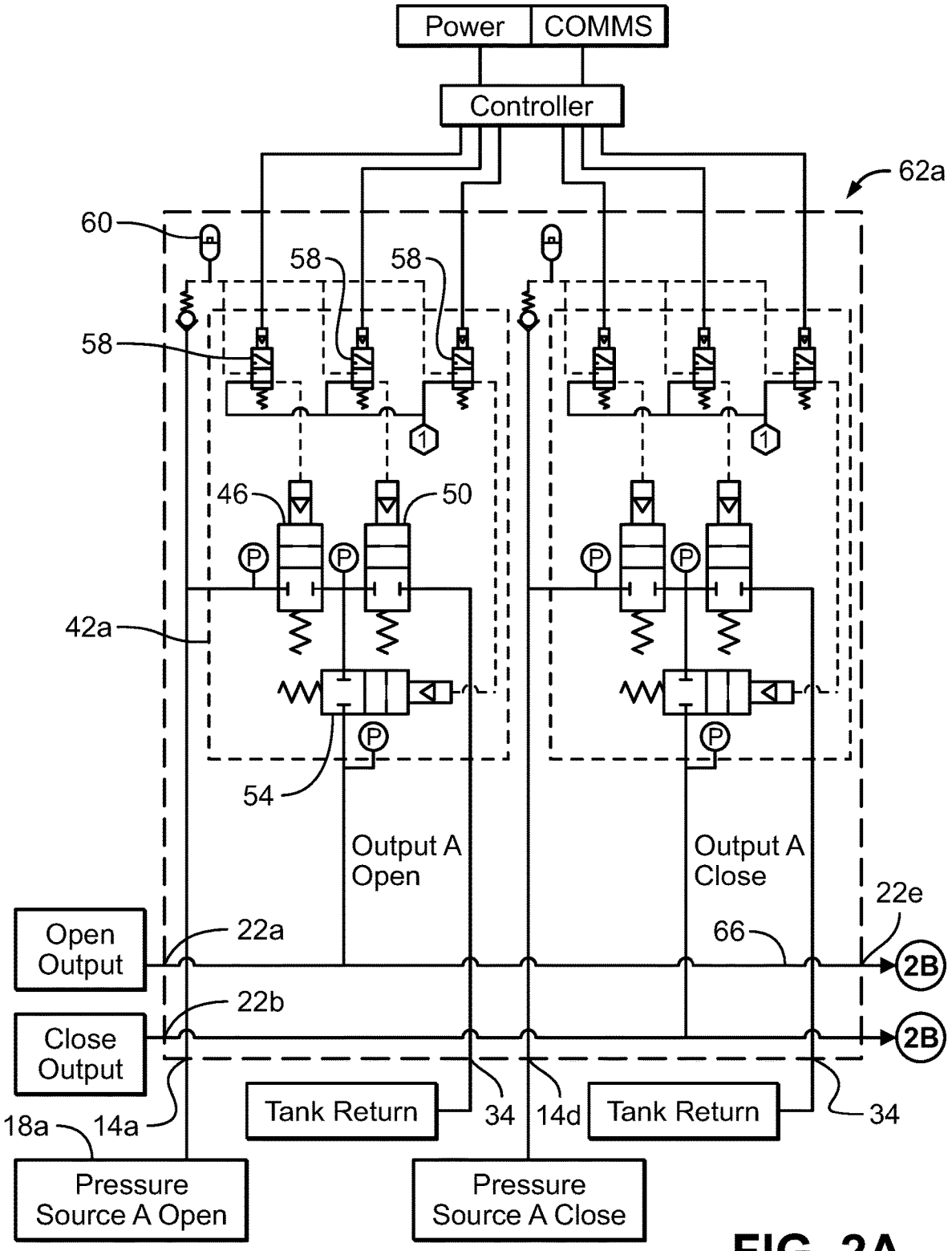
FIG. 2A-2C are a diagram of the manifold of FIG. 1A.
Figure 2B:
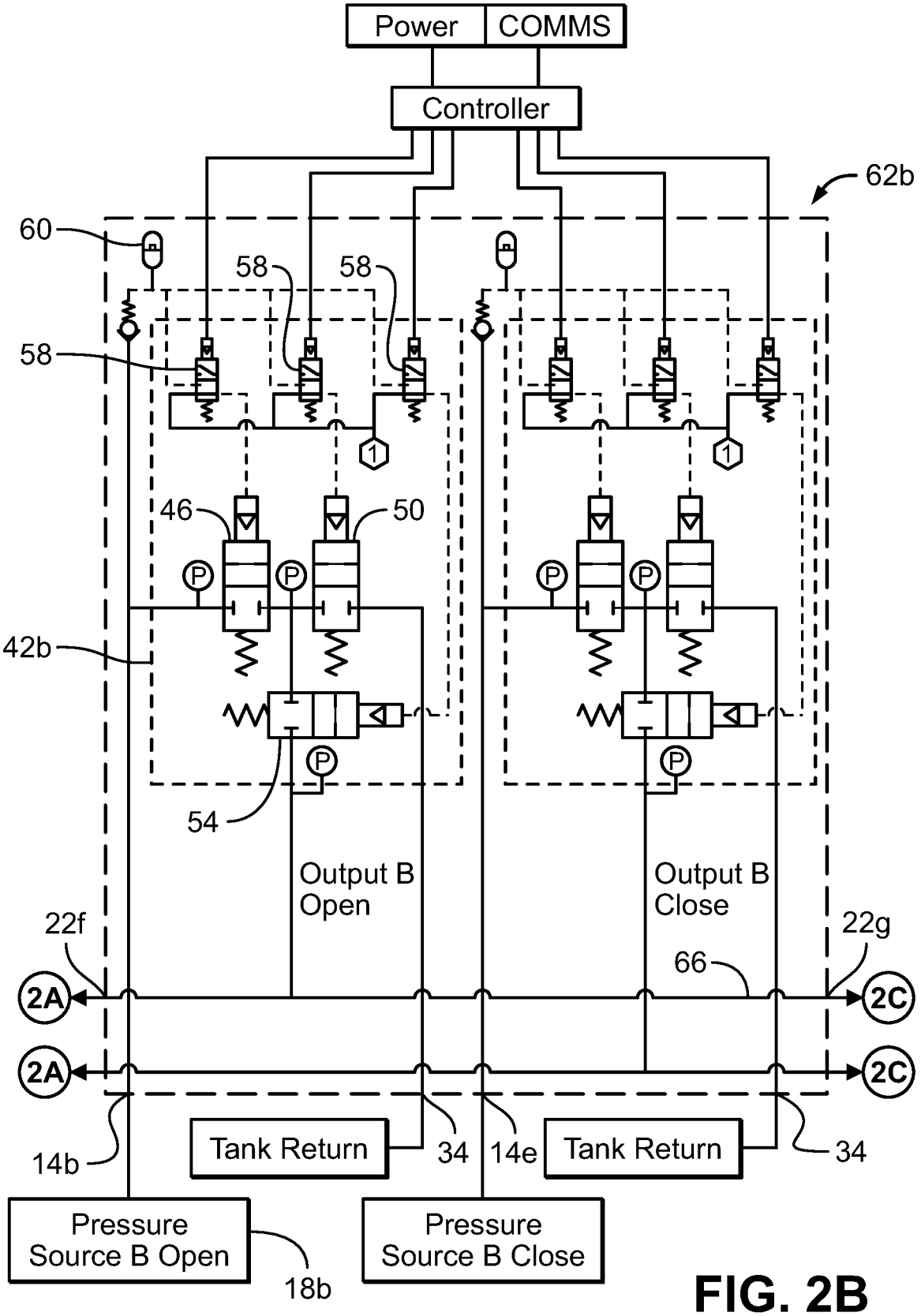
Figure 2C:
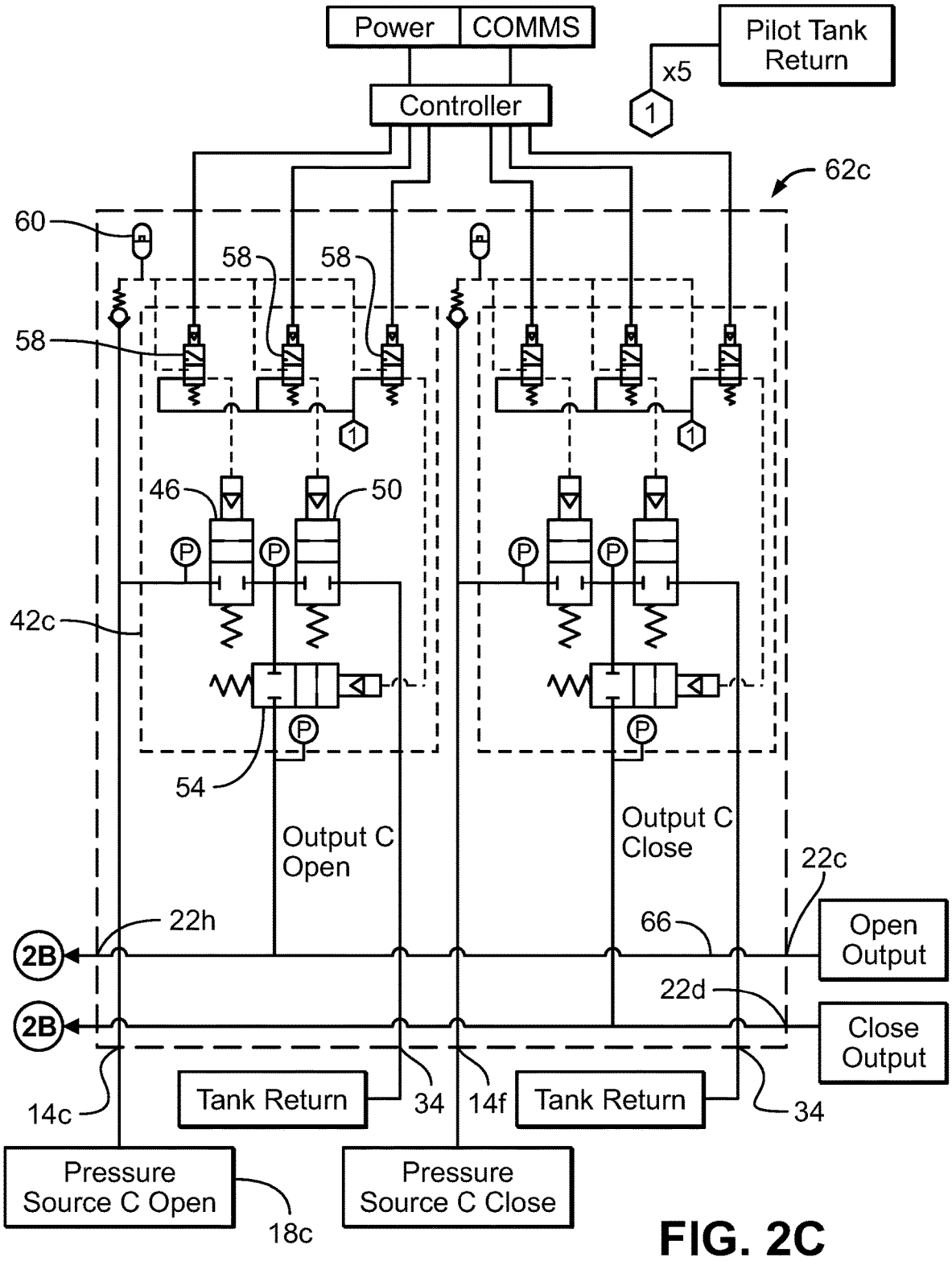

Best shown in FIG. 2A-2C, in the depicted embodiment, manifold 10*a* comprises one or more subsea valve assemblies (e.g., valve assembly 42*a*) (e.g., six (6) subsea valve assemblies, as shown), sometimes referred to collectively as "valve assemblies 42." A valve assembly is a collection of valves, and may include, but is not limited to including, main stage valves, pilot stage valves, isolation valves, check valves, relief valves, and/or the like (described in more detail below). The following description of valve assembly 42*a* is provided by way of example, and other valve assemblies 42 may or may not comprise any and/or all of the features described below with respect to valve assembly 42*a*. In this embodiment, valve assembly 42*a* is configured to selectively control hydraulic fluid communication from inlet 14*a* to outlet 22*a*. In the depicted embodiment, valve assembly 42*a* is at least partially contained within body or housing 38.

Valves of the present manifolds (e.g., main stage valves, pilot stage valves, isolation valves, relief valves, and/or the like, described in more detail below) can comprise any suitable valve, such as, for example spool valves, poppet valves, ball valves and/or the like, and can comprise any suitable configuration, such as, for example, two-position two-way (2P2W), 2P3W, 2P4W, 3P4W, and/or the like. Valves of the present manifolds may be normally closed (e.g., which may increase fault tolerance, for example, by providing failsafe functionality), and/or normally open. In this embodiment, valves that are configured to directly control hydraulic fluid communication to and/or from a hydraulically actuated device (e.g., 30) (e.g., first two-way valve 46, second two-way valve 50, main stage valves, isolation valves 54, and/or the like) are configured to withstand hydraulic fluid pressures of up to 7,500 pounds per square inch gauge (psig) or larger and ambient pressures of up to 5,000 psig, or larger.

The following description of a valve assembly 42*a* is provided only by way of example, and not by way of limitation. In the embodiment shown, valve assembly 42*a* comprises a first two-way valve 46 configured to selectively allow fluid communication from inlet 14*a* to outlet 22*a* (e.g., to hydraulically actuated device 30), and a second two-way valve 50 configured to selectively divert hydraulic fluid from outlet 22*a* (e.g., from the hydraulically actuated device) to at least one of a reservoir (shown and described, below) and a subsea environment (e.g., via a vent 34). In this embodiment, two-way valves 46 and 50 are configured as on-off valves such that actuation of valve assembly 42*a* is digital; however, in other embodiments, one or more valves (e.g., 46, 50, and/or the like) may be analog.

The use of two two-way valves (e.g., as opposed to a single three-way valve) facilitates valve assembly 42*a* in reducing potential single points of failure. For example, in the embodiment shown, in the event that two-way valve 46 sticks open, two-way valve 50 can be actuated to divert hydraulic fluid from fluid source 18*a* (e.g., through a vent 34 and to at least one of reservoir and a subsea environment) (e.g., to mitigate undesired actuation of hydraulically actuated device 30). By way of further example, in the event that two-way valve 50 sticks open, two-way valve 46 can be actuated to isolate valve assembly 42*a* from fluid source 18*a* (e.g., to prevent loss of hydraulic fluid through vent 34). Thus, if either valve fails, the other valve can function to mitigate and/or reduce any negative impact on the hydraulic system (e.g., hydraulically actuated device 30, manifold 10*a*, and fluid source 18*a*). Thus, implementation of two two-way valves (e.g., as in valve assembly 42*a*) can increase reliability and fault tolerance over a single (e.g., three-way valve) configuration, despite potentially requiring more components. Additionally, two-way valves are generally less expensive and less complicated than three-way valves and may provide for a better seal and be more robust.

Some embodiments of the present methods for controlling hydraulic fluid flow between a hydraulically actuated device (e.g., 30) of a blowout preventer and a fluid source (e.g., 18*a*) comprise actuating a first two-way valve (e.g., 46) of a manifold (e.g., 10*a*) coupled in fluid communication with and between the hydraulically actuated device and the fluid source to selectively allow fluid communication between the fluid source and the hydraulically actuated device, and actuating a second two-way valve (e.g., 50) of the manifold to selectively divert hydraulic fluid from at least one of the fluid source and the hydraulically actuated device to at least one of a reservoir and a subsea environment (e.g., via a vent 34).

Such two-way valves can provide a variety of (e.g., additional) benefits, non-limiting examples of which are described below. For example, in the embodiment shown, two-way valves 46 and 50 can be actuated such that hydraulic fluid loss is minimized during actuation of valve assembly 42*a*. To illustrate, before either two-way valve 46 or 50 is opened, both two-way valves can be closed. In this way, flow short-circuiting (e.g., flow from fluid source 18*a* to a vent 34) can be reduced.

Some embodiments of the present methods for controlling hydraulic fluid flow between a hydraulically actuated device (e.g., 30) of a blowout preventer and a fluid source (e.g., 18*a*) comprise actuating a first two-way valve and a second two-way valve (e.g., 46 and 50, respectively) such that both the first and second two-way valves are closed, and after both the first and second two-way valves are closed, actuating one of the first or second two-way valves such that the one of the first or second two-way valves is opened.

Valve assemblies (e.g., 42*a*) comprising at least two valves (e.g., first two-way valve 46 and second two-way valve 50) can be configured to facilitate flushing of the valve assembly, manifold (e.g., 10*a*), and/or hydraulically actuated device (e.g., 30) with hydraulic fluid. For example, in the embodiment shown, first two-way valve 46 and second two-way valve 50 may both be opened such that hydraulic fluid from fluid source 18*a* communicates from inlet 14*a*, through valve assembly 42*a*, and to a vent 34, reservoir, subsea environment, and/or the like. In this way, for example, in the event that sea water enters valve assembly 42*a*, manifold 10*a*, or hydraulically actuated device 30, hydraulic fluid from fluid source 18*a* can be used to expel or flush at least a portion of the sea water from the valve assembly, manifold, and/or hydraulically actuated device.

In some embodiments, valves of the present manifolds (e.g., two-way valve 46, two-way valve 50, main stage valves, isolation valves 54, and/or the like) can be configured to mitigate the occurrence and/or impact of fluid hammer (e.g., a pressure surge or wave that may occur when fluid undergoes sudden momentum changes). For example, in some embodiments, such valves can be configured to provide for gradual changes in fluid flow rate through the valve (e.g., through configuration of valve flow area, closing and/or opening speed, and/or the like), thus minimizing changes in hydraulic fluid momentum during actuation of the valve.

In the embodiment shown, actuation of two-way valves 46 and 50 can mitigate the occurrence and/or impact of fluid hammer. For example, two-way valve 50 can be actuated to divert a portion of hydraulic fluid (e.g., to vent 34) when opening or closing two-way valve 46. In this way, two-way valve 50 can be actuated to relieve sharp pressure rises or rapid momentum changes in hydraulic fluid flowing through valve assembly 42*a*, manifold 10*a* and/or hydraulically actuated device 30 that may otherwise result from opening or closing of two-way valve 46.

Some embodiments of the present methods for controlling hydraulic fluid flow between a hydraulically actuated device (e.g., 30) of a blowout preventer and a fluid source (e.g., 18*a*) comprise actuating a second two-way valve (e.g., 50) such that the second two-way valve is open, after the second two-way valve is open, actuating the first two-way valve (e.g., 46) such that the first two-way valve is open such that hydraulic fluid from the fluid source is diverted to at least one of a reservoir and a subsea environment, and after both the first and second two-way valves are opened, actuating the second two-way valve such that the second two-way valve is closed such that hydraulic fluid from the fluid source is directed to the hydraulically actuated device.

In the embodiment shown, valve assembly 42*a* comprises one or more isolation valves 54 (described in more detail below). In this embodiment, one or more isolation valves 54 can be actuated before and/or after actuation of other valves (e.g., first two-way valve 46 and/or second two-way valve 50, main stage valves, and/or the like). In this way, an isolation valve 54 can be configured to mitigate, for example, undesired actuation of a hydraulically actuated device (e.g., 30), undesired loss of hydraulic fluid, and/or the occurrence and/or impact of fluid hammer.

To illustrate, some embodiments of the present methods for controlling hydraulic fluid flow between a hydraulically actuated device (e.g., 30) of a blowout preventer and a fluid source (e.g., 18*a*) comprise actuating an isolation valve (e.g., 54) in fluid communication between the fluid source and a first two-way valve (e.g., 46) to selectively block fluid communication between the fluid source and the first two-way valve (e.g., to selectively isolate valve assembly 42*a* from fluid source 18*a*). Some embodiments comprise actuating an isolation valve (e.g., 54) in fluid communication between at least one of a reservoir and a subsea environment (e.g., vent 34) and a second two-way valve (e.g., 50) to selectively block fluid communication between the second two-way valve and the at least one of the reservoir and the subsea environment (e.g., vent 34) (e.g., to selectively isolate a valve assembly 42 from a vent 34, reservoir, subsea environment, and/or the like).

Through configuration of inlet(s) 14, outlet(s) 22, valve assemblies 42, and/or the like, some embodiments of the present manifolds are configured to provide hydraulic fluid to a hydraulically actuated device from at least two separate fluid sources, whether simultaneously (e.g., passive redundancy) and/or by selecting between the separate fluid sources (e.g., active redundancy). For example, in the embodiment shown, manifold 10*a* (e.g., through configuration of valve assemblies 42) is configured to allow each outlet 22 to be in fluid communication with at least two of inlets 14 (e.g., outlet 22*a* in fluid communication with three (3) inlets, 14*a*, 14*b*, 14*c*, as shown, outlet 22*b* in fluid communication with three (3) inlets, 14*d*, 14*e*, 14*f*, as shown). However, in other embodiments, the present manifolds can be configured to allow each outlet 22 to be in fluid communication with any number of inlets 14, such as, for example, one inlet, two inlets (dual-mode redundancy), three inlets (triple-mode redundancy), four inlets (quadruple-mode redundancy), or more inlets (n-mode redundancy).

Some embodiments of the present methods for providing hydraulic fluid to a hydraulically actuated device (e.g., 30) of a blowout preventer comprise coupling at least a first fluid source (e.g., 18*a*) and a second fluid source (e.g., 18*b*) into fluid communication with an actuation port of the hydraulically actuated device. Some embodiments comprise coupling the first fluid source to a first inlet (e.g., 14*a*) of a manifold (e.g., 10*a*) having an outlet (e.g., 22*a*) in fluid communication with the first inlet and the hydraulically actuated device, and coupling the second fluid source to a second inlet (e.g., 14*b*) of the manifold, the second inlet in fluid communication with the outlet (e.g., dual-mode redundancy). Some embodiments comprise coupling a third fluid source (e.g., 18*c*) into fluid communication with the actuation port of the hydraulically actuated device. Some embodiments comprise coupling the third fluid source to a third inlet (e.g., 14*c*) of the manifold, the third inlet in fluid communication with the outlet (e.g., triple-mode redundancy).

Some embodiments of the present methods for controlling hydraulic fluid flow between a hydraulically actuated device (e.g., 30) of a blowout preventer and at least two fluid sources (e.g., 18*a*, 18*b*, 18*c*, and/or the like) comprise actuating a first valve assembly (e.g., 42*a*) of a manifold (e.g., 10*a*) to allow communication of hydraulic fluid from a first fluid source (e.g., 18*a*) to an outlet (e.g., 22*a*) of the manifold, the outlet in fluid communication with an actuation port of the hydraulically actuated device, monitoring, with a processor (e.g., 86, described in more detail below), hydraulic fluid pressure at the outlet, and actuating a second valve assembly (e.g., 42*b*) of the manifold to allow communication of hydraulic fluid from a second fluid source (e.g., 18*b*) to the outlet if hydraulic fluid pressure at the outlet is below a threshold (e.g., a minimum operation pressure) (e.g., dual-mode active redundancy). Some embodiments comprise actuating an isolation valve (e.g., 54) of the manifold to block communication of hydraulic fluid from the first fluid source to the outlet of the manifold if hydraulic fluid pressure at the outlet is below a threshold.

Figure 4A:
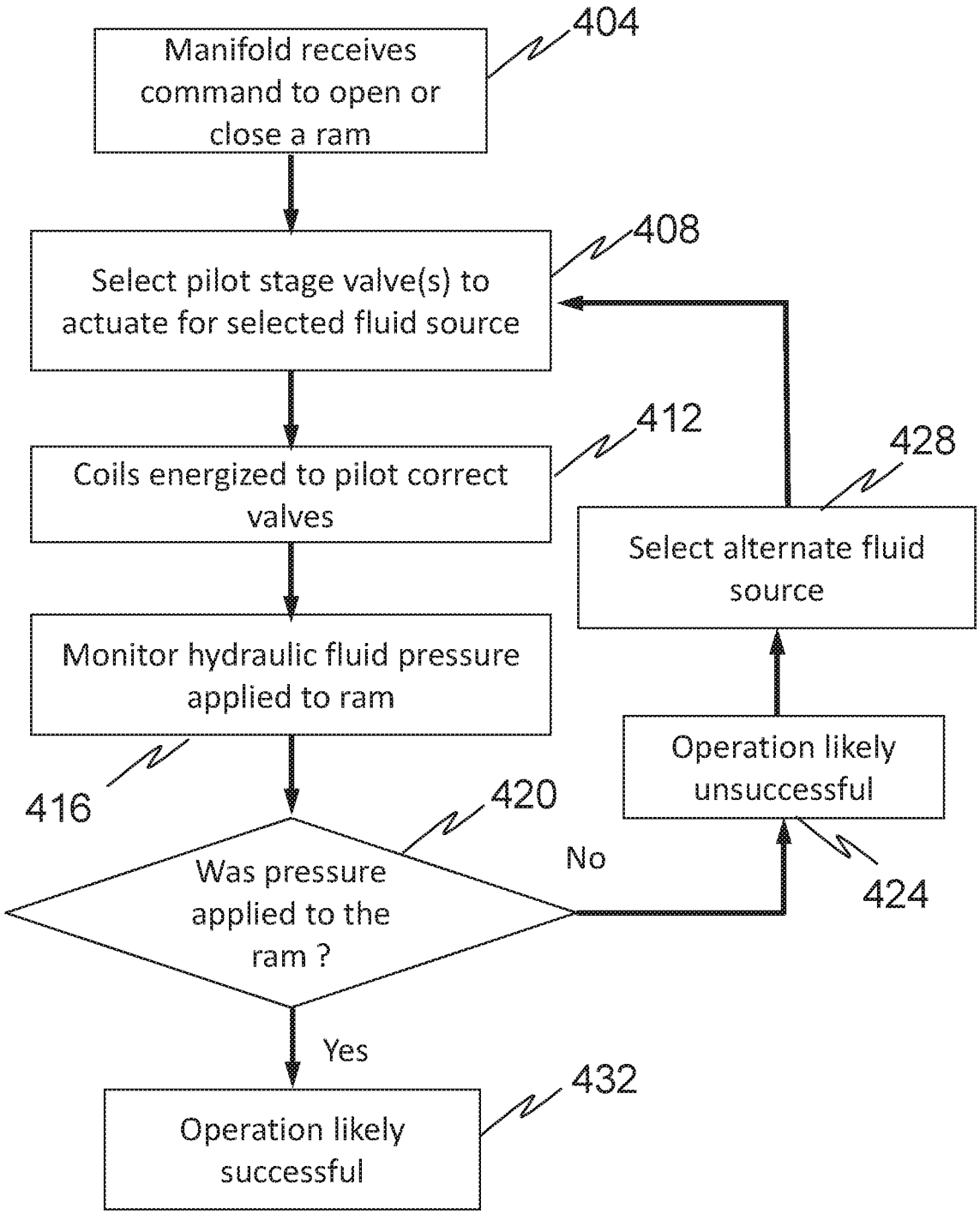
FIGS. 4A and 4B are flowcharts of some embodiments of the present methods for controlling a hydraulically actuated device of a blowout preventer.
Figure 4B:
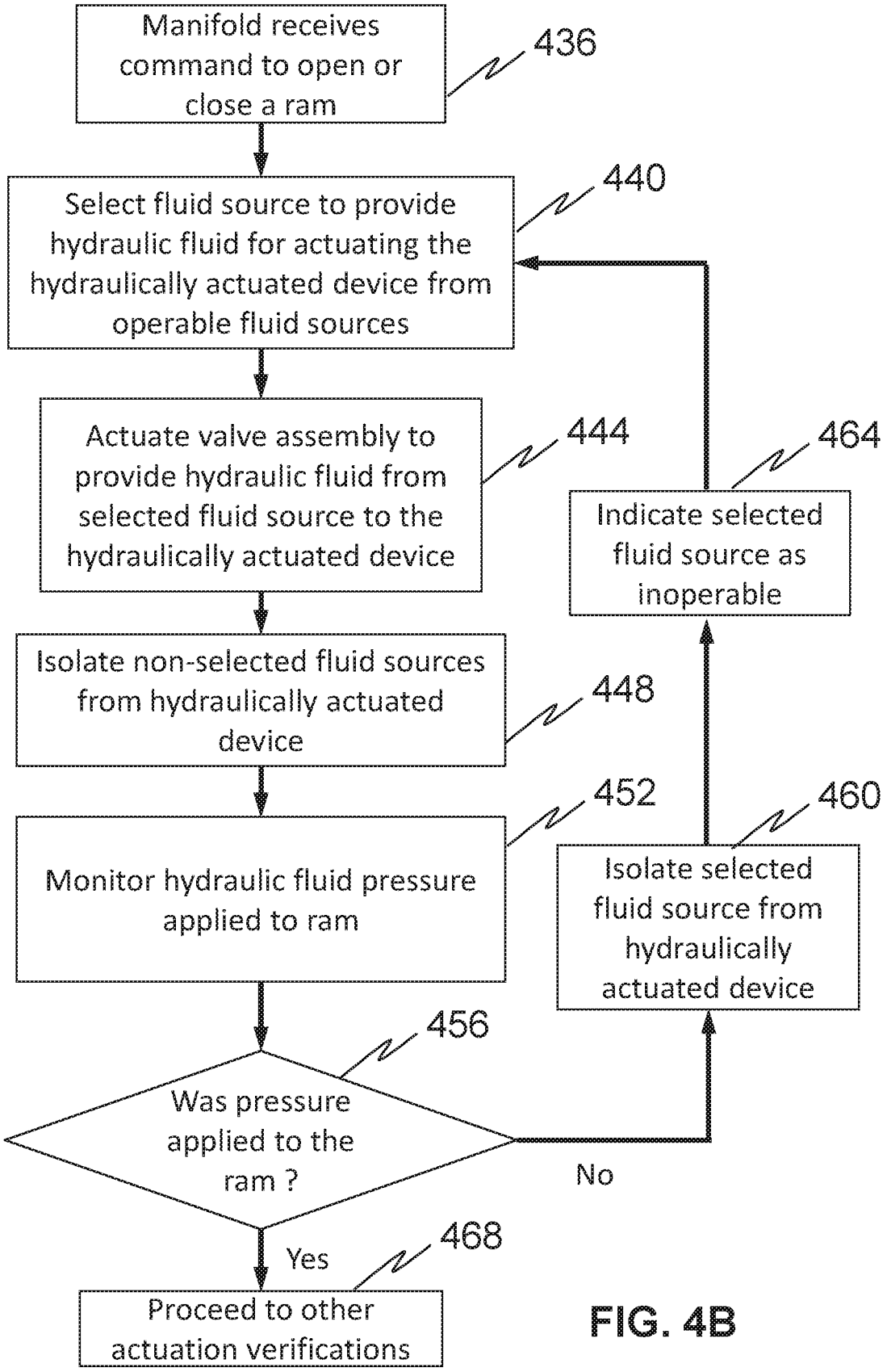
Figure 5A:
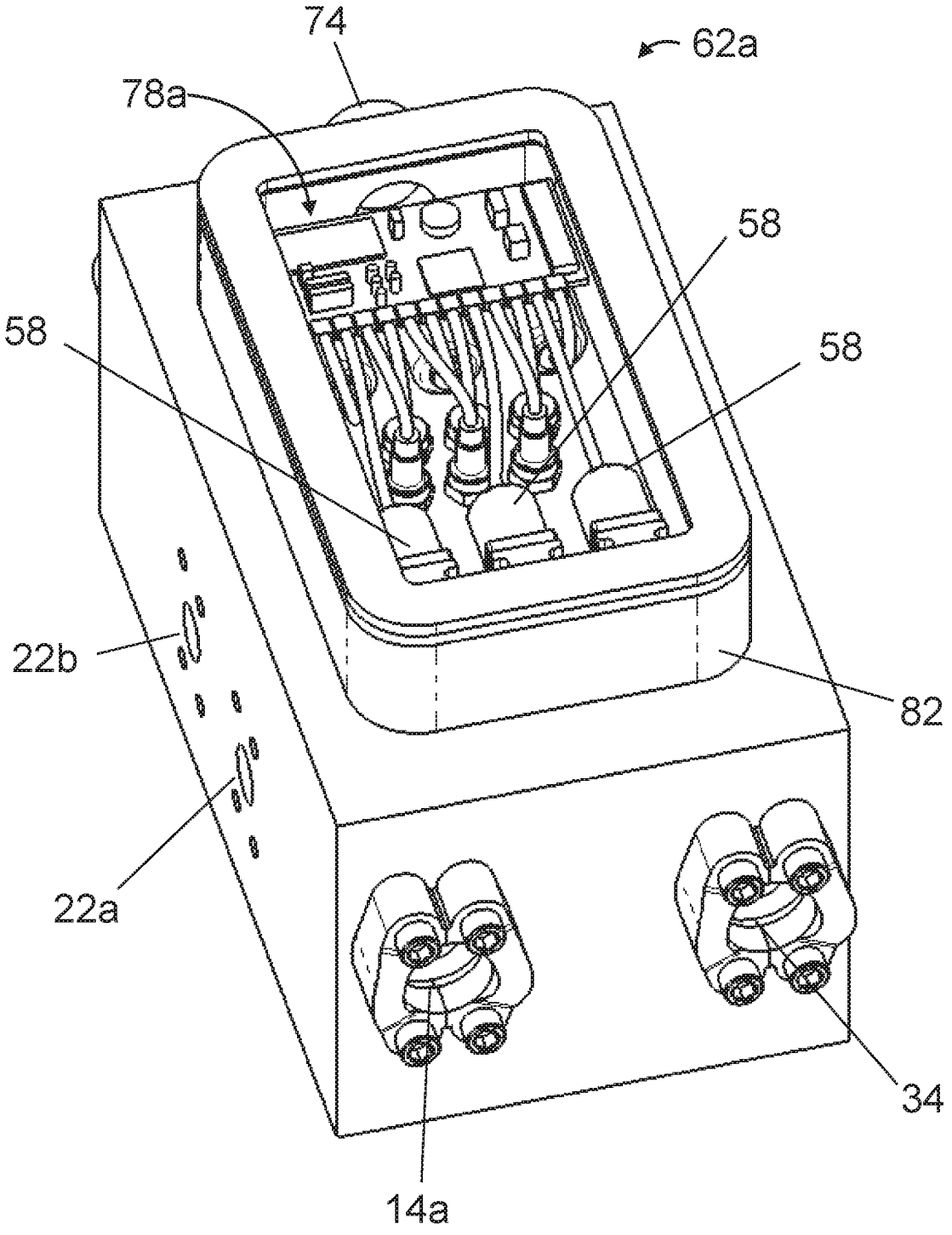
FIG. 5A is a top perspective view of a subsea valve module of the manifold of FIG. 1A.
Figure 5B:
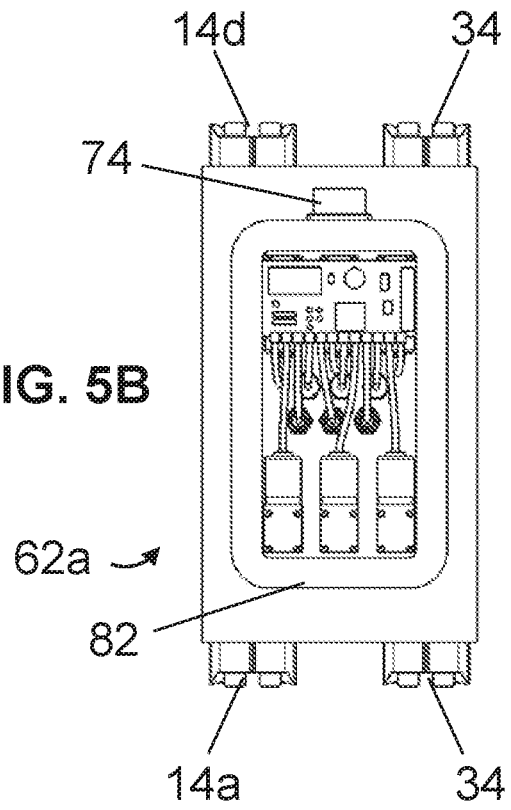
FIGS. 5B and 5C are top and bottom views, respectively, of the subsea valve module of FIG. 5A.
Figure 5C:
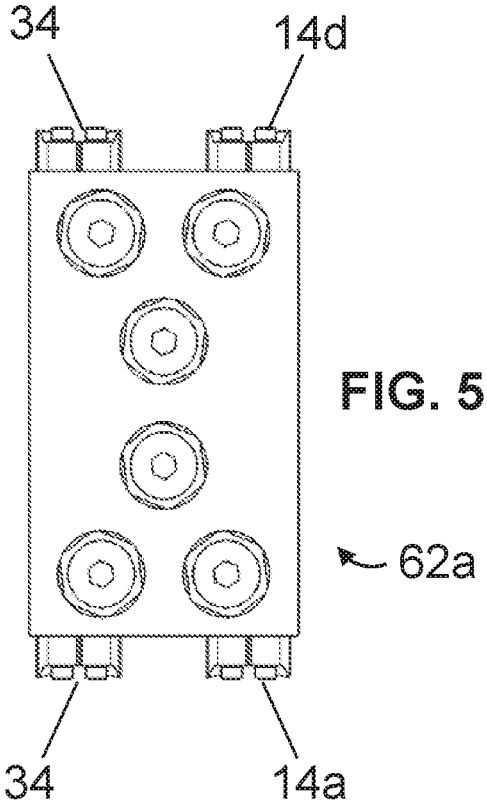
Figure 5D:
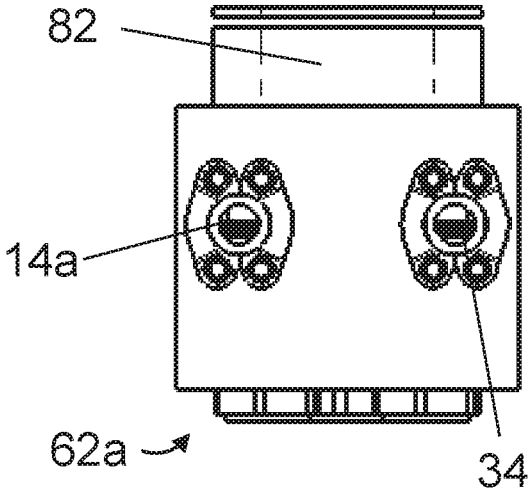
FIGS. 5D and 5E are opposing side views of the subsea valve module of FIG. 5A.
Figure 5E:
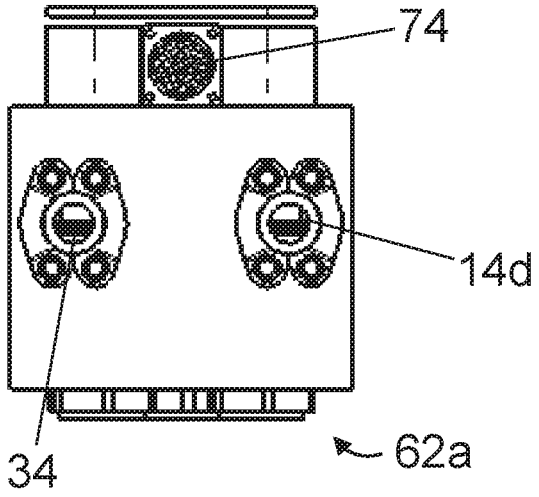
Figure 5F:
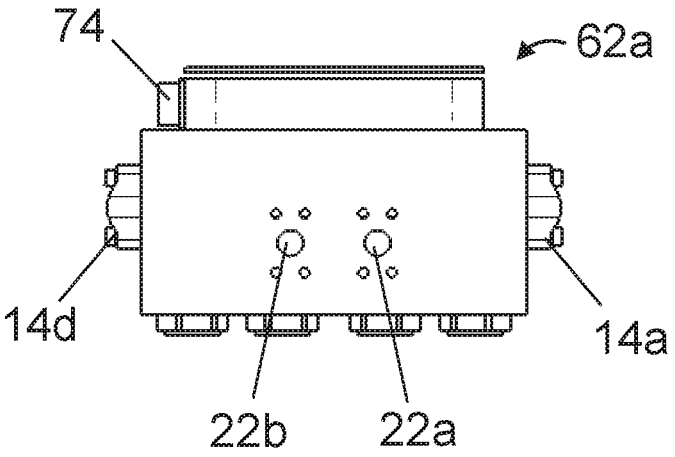
FIGS. 5F and 5G are opposing end views of the subsea valve module of FIG. 5A.
Figure 5G:
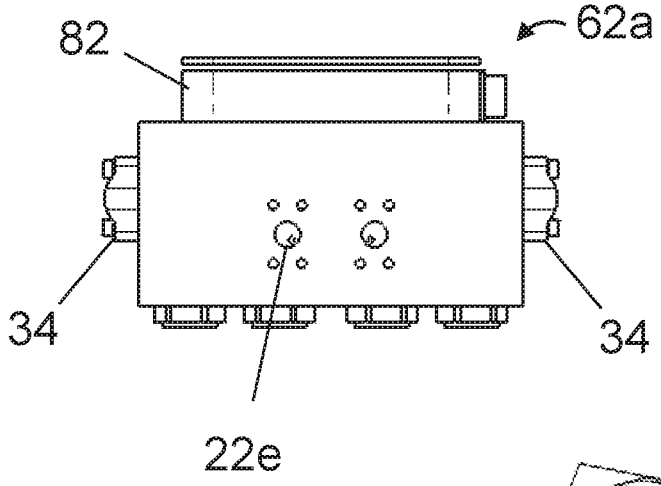
Figure 5H:
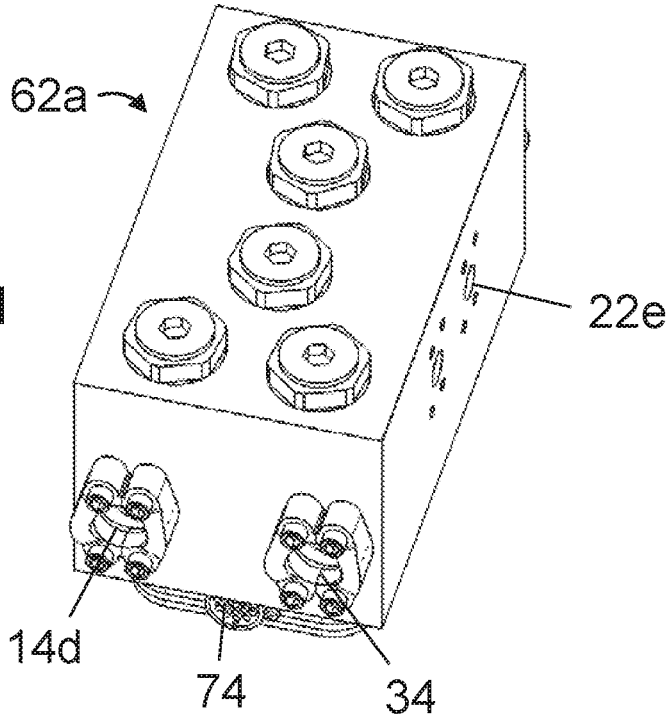
FIG. 5H is a bottom perspective view of the subsea valve module of FIG. 5A.
Figure 6:
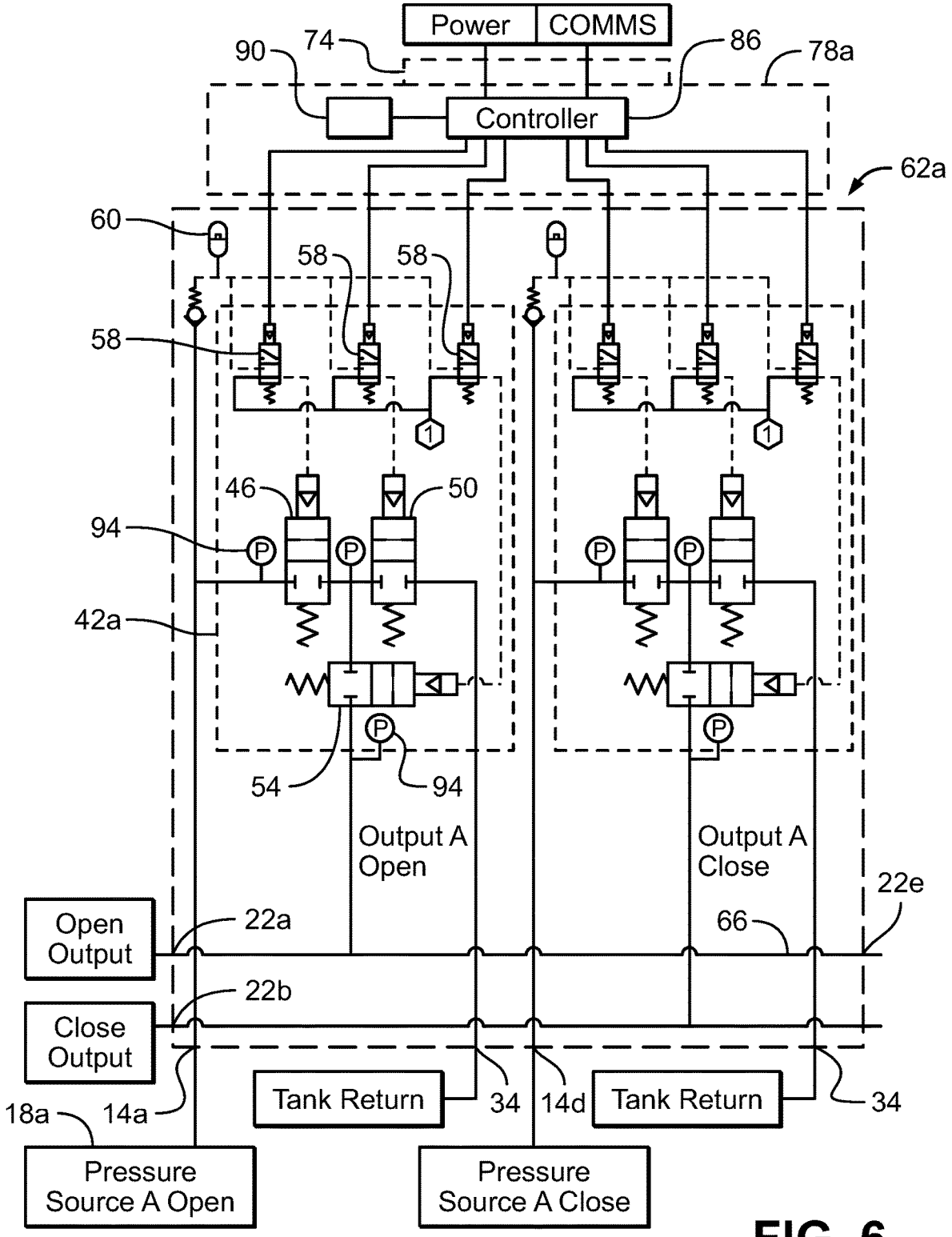
FIG. 6 is a diagram of the subsea valve module of FIG. 5A.

Referring additionally to FIGS. 4A and 4B, shown are flowcharts for some embodiments of the present methods for controlling a hydraulically actuated device (e.g., 30) of a blowout preventer (e.g., using active redundancy). For example, in FIG. 4A, at step 404, a manifold (e.g., 10*a*) can receive a command (e.g., via an electrical connector 74, control circuit 78*a* and/or 78*b*, and/or the like) to actuate a hydraulically actuated device of a blowout preventer (e.g., to open or close a ram). In this example, at step 408, pilot stage valves (e.g., 58, described in more detail below) can be selected for actuation, for example, depending on the fluid source (e.g., 18*a*, 18*b*, 18*c*, and/or the like) selected to provide hydraulic fluid for actuating the hydraulically actuated device. In the depicted example, at step 412, the selected pilot stage valves can be actuated to pilot the main stage valves controlling hydraulic fluid communication from the selected fluid source to the hydraulically actuated device (e.g., by energizing coils of the selected pilot stage valves, if the selected pilot stage valves are electrically actuated). In the example shown, hydraulic fluid pressure at the manifold outlet (e.g., 22*a*) can be monitored at step 416 (e.g., by one or more sensors 94) (e.g., to determine if the hydraulically actuated device is receiving pressurized hydraulic fluid). At step 420, in this example, if the hydraulically actuated device is receiving pressurized hydraulic fluid (e.g., at a sufficient pressure, such as, for example, above a minimum operating pressure of the hydraulically actuated device), the actuation may be considered likely successful at step 432. However, in the depicted example, if the hydraulically actuated device is not receiving pressurized hydraulic fluid (e.g., at a sufficient pressure), the actuation may be considered likely unsuccessful at step 424. At step 428, in this example, another fluid source (e.g., 18*a*, 18*b*, 18*c*, and/or the like) may be selected (e.g., by an operator, a processor 86, and/or the like), and steps 408 through 420 may be repeated.

In FIG. 4B, for example, at step 436, a manifold (e.g., 10*a*) can receive a command (e.g., via an electrical connector 74, control circuit 78*a* and/or 78*b*, and/or the like) to actuate a hydraulically actuated device of a blowout preventer (e.g., to open or close a ram). In this example, at step 440, a fluid source (e.g., 18*a*, 18*b*, 18*c*, and/or the like) can be selected to provide hydraulic fluid for actuating the hydraulically actuated device (e.g., from a list of fluid sources that are indicated as operable) (e.g., by an operator, a processor 86, and/or the like). At step 444, in the depicted example, a valve assembly (e.g., 42) can be actuated to provide hydraulic fluid from the selected fluid source to the hydraulically actuated device. In the example shown, at step 448, non-selected fluid sources may be isolated from the hydraulically actuated device (e.g., by actuating one or more isolation valves 54). At step 452, in this example, hydraulic fluid pressure at the manifold outlet (e.g., 22*a*) can be monitored (e.g., by one or more sensors 94) (e.g., to determine if the hydraulically actuated device is receiving pressurized hydraulic fluid). At step 456, in this example, if the hydraulically actuated device is receiving pressurized hydraulic fluid (e.g., at a sufficient pressure, such as, for example, above a minimum operating pressure of the hydraulically actuated device), further verifications of successful operation can be performed at step 468. However, in the depicted example, if the hydraulically actuated device is not receiving pressurized hydraulic fluid (e.g., at a sufficient pressure), the selected fluid source can be isolated from the hydraulically actuated device at step 460 (e.g., by actuating one or more isolation valves 54). At step 464, in this example, the selected fluid source may be indicated as inoperable, and steps 440 through 456 may be repeated.

In some embodiments, passive redundancy can be facilitated by the absence of a shuttle valve (e.g., thus allowing at least two separate fluid sources, such as, for example, 18*a* and 18*b*, to be in simultaneous fluid communication with the hydraulically actuated device). A shuttle valve may constitute a common single point of failure in current blowout preventer hydraulic systems. For example, if a shuttle valve sticks, one or more hydraulically actuated devices of an associated blowout preventer may be rendered inoperable. Therefore, the absence of such shuttle valves may increase overall system reliability.

Depending on state of valve assemblies 42 manifold 10*a* is capable of, configured to, and, some embodiments, normally operated with each outlet 22 being in simultaneous fluid communication with at least two inlets 14 (e.g., when two-way valves 46 and 50 of a valve assembly 42 associated with a first inlet are in the open and closed position, respectively, and two-way valves 46 and 50 of a valve assembly 42 associated with a second inlet are in the open and closed position, respectively).

For example, some embodiments of the present methods comprise providing hydraulic fluid to the hydraulically actuated device simultaneously from at least the first fluid source and the second fluid source (e.g., dual-mode passive redundancy). By way of further example, some embodiments of the present methods comprise providing hydraulic fluid to the hydraulically actuated device simultaneously from the first fluid source, the second fluid source, and the third fluid source (e.g., triple-mode passive redundancy).

In some embodiments, a pressure supplied from a fluid source (e.g., 18*a*, 18*b*, 18*c*, and/or the like) to a hydraulically actuated device can be adjusted (e.g., via a regulator 102, described in more detail below, whether external and/or internal to manifold 10*a*). For example, some embodiments of the present methods comprise adjusting a pressure of at least one fluid source to a higher pressure than a pressure of at least one other fluid source.

In some embodiments (e.g., 10*a*), the present manifolds can be configured such that the fluid sources can be controlled in such a way to reduce pressure spikes within the manifold, valve assemblies 42, and/or hydraulically actuated device 30 (e.g., fluid hammer). For example, some embodiments can be configured such that at least two valve assemblies 42, each associated with a respective separate fluid source, actuate to provide hydraulic fluid to an outlet 22 sequentially (e.g., where actuation of at least one valve assembly 42 to supply hydraulic fluid from a first fluid source occurs after actuation of at least one other valve assembly 42 to supply hydraulic fluid from a second fluid source).

For example, some embodiments of the present methods for providing hydraulic fluid to a hydraulically actuated device (e.g., 30) of a blowout preventer comprise providing hydraulic fluid to the hydraulically actuated device from at least one fluid source (e.g., 18*a*, via actuation of valve assembly 42*a*) before providing hydraulic fluid to the hydraulically actuated device from at least one other fluid source (e.g., 18*b*, via actuation of valve assembly 42*b*).

Manifolds of the present disclosure can be configured to actuate any number of hydraulically actuated devices and/or functions thereof. For example, in the embodiment shown, manifold 10*a* comprises two outlets (e.g., 22*a* and 22*b*), each configured to be in fluid communication with a respective port of a hydraulically actuated device (e.g., outlet 22*a* in fluid communication with a close port and outlet 22*b* in fluid communication with an open port) and/or a port of a respective hydraulically actuated device (e.g., outlet 22*a* in fluid communication with a port of a first hydraulically actuated device and outlet 22*b* in fluid communication with a port of a second hydraulically actuated device). At least in part due to outlets 22*a* and 22*b*, manifold 10*a* is configured to actuate at least two functions of a hydraulically actuated device and/or at least two hydraulically actuated devices (e.g., manifold 10*a* is a two-function manifold). However, in other embodiments, the present manifolds can be configured to actuate any suitable number of hydraulically actuated devices, such as, for example, a number greater than any one of, or between any two of: 1, 2, 3, 4, 5, 6, 7, 8, 9, 10, 15, 20, 25, 30, 35, 40, 45, 50, 55, 60, or more hydraulically actuated devices and/or functions of hydraulically actuated devices (e.g., and the devices and/or functions can each be in fluid communication with a respective outlet of the manifold).

In this embodiment, manifold 10*a* is configured such that each of outlets 22 is in fluid communication with a respective set of at least two inlets 14 (e.g., depending on state of valve assemblies 42, as described above). For example, in this embodiment, manifold 10*a* is configured such that outlet 22*a* is in fluid communication with inlets 14*a*, 14*b*, and 14*c* and such that outlet 22*b* is in fluid communication with inlets 14*d*, 14*e*, and 14*f*. As shown, inlets 14*a*, 14*b*, and 14*c* associated with outlet 22*a* are disposed on a substantially opposite side of manifold 10*a* from inlets 14*d*, 14*e*, and 14*f* associated with outlet 22*b*; however, in other embodiments, the present manifolds can comprise any suitable configuration (e.g., with inlets 14*a*, 14*b*, and 14*c* on a same side of manifold as inlets 14*d*, 14*e*, and 14*f*, such that, for example, a single hydraulic stab can place each of inlets 14 in fluid communication with a fluid source (e.g., 18*a*, 18*b*, 18*c*, and/or the like).

While manifold 10*a* has been described with respect to inlets 14 and vents 34, as will be apparent to one of ordinary skill in the art, vents 34 of some embodiments of the present manifolds can be placed in fluid communication with a fluid source (e.g., 18*a*, 18*b*, 18*c*, and/or the like). Thus, in some instances, vents 34 can be configured to function as inlets 14. In this way, for example, if one of inlets 14 and/or a connected fluid source becomes inoperable for conveying hydraulic fluid to an associated one of outlets 22, a vent 34 (e.g., in fluid communication with the associated valve assembly 42) can be placed in fluid communication with a fluid source (e.g., to maintain at least some of the functionality of the manifold). In the embodiment shown, each of outlets 22 are in selective fluid communication with at least two of vents 34. In this way, in the event that a vent becomes inoperable (e.g., a two-way valve 50 sticks closed), at least one other vent is operable, for example, to mitigate hydrolocking of hydraulically actuated device 30.

As described above, valves (e.g., e.g., two-way valve 46, two-way valve 50, main stage valves, isolation valves 54, and/or the like) and/or valve assemblies 42 of the present manifolds can comprise any suitable configuration. For example, in the embodiment shown, at least one of the valve assemblies (e.g., 42*a*) comprises a hydraulically actuated main stage valve (e.g., two-way valve 46 and/or two-way valve 50). However, in other embodiments, main stage valves may be actuated in any suitable fashion, such as, for example, pneumatically, electrically, mechanically, and/or the like.

In this embodiment, at least one of the valve assemblies (e.g., 42*a*) comprises a pilot stage valve 58 configured to actuate a main stage valve. For example, in the embodiment shown, two-way valves 46 and 50 are each hydraulically actuated, and each are in fluid communication with and configured to be actuated through hydraulic fluid provided by way of a pilot stage valve 58. In these embodiments, hydraulic fluid communicated by pilot stage valves 58 can be supplied from any suitable source (whether regulated or unregulated), such as, for example, a fluid source associated with the valve assembly (e.g., 18*a*, 18*b*, 18*c*, and/or the like) and/or a separate fluid source. In this embodiment, manifold 10*a* comprises one or more accumulators 60 configured to store pressurized hydraulic fluid for communication by one or more pilot stage valves 58.

Similarly to as described for main stage valves (two-way valve 46 and/or two-way valve 50), pilot stage valves 58 can be actuated hydraulically, pneumatically, electrically, mechanically, and/or the like. For example, in the embodiment shown, at least one pilot stage valve 58 is configured to be electrically actuated. Such electrically actuated valves may be smaller and/or capable of actuating more quickly than some hydraulically actuated valves. By way of example, in the embodiment shown, at least one pilot stage valve comprises and/or is in electrical communication with an electrical solenoid configured to open and/or close the valve. Electrical solenoids of pilot stage valve(s) 58 may be actuated by applying a current (e.g., whether direct or alternating) (e.g., from a battery, through an electrical connector, and/or the like as described in more detail below) to the electrical solenoid. In this way, a comparatively low power electrical signal may be used to actuate pilot stage valve 58, which may then communicate comparatively high power hydraulic fluid to actuate a main stage valve. In the embodiment shown, pilot stage valve 58 may be contained within a pressure-compensated housing (described in more detail below).

In the embodiment shown, at least one the valve assemblies (e.g., 42*a*) comprises one or more isolation valves 54. Isolation valves of the present manifolds can comprise any suitable valve, such as, for example, check valves, ball valves, poppet valves, spool valves, reed valves, one-way valves, two-way valves, and/or the like, and may be actuated hydraulically (e.g., whether or not via hydraulic fluid communicated by a pilot stage valve 58), pneumatically, electrically, mechanically (e.g., automatically or manually, for example, by an ROV), and/or the like. In this embodiment, isolation valves 54 are each configured to selectively block fluid communication through at least one of inlets 14. In this way, isolation valves 54 can be actuated to hydraulically isolate a portion of manifold 10*a*, a valve assembly 42 (e.g., 42*a*), a fluid source (e.g., 18*a*, 18*b*, 18*c*, and/or the like) from, for example, an external component and/or a subsea environment. For example, in the event of a failure or malfunction of a manifold, valve assembly, fluid source, and/or the like, an isolation valve 54 can be actuated (e.g., to prevent undesired hydraulic fluid loss and/or undesired actuation of a hydraulically actuated device).

In some embodiments, at least one of isolation valves 54 is configured to automatically block fluid communication through at least one of inlets 14 upon decoupling of a fluid source (e.g., 18*a*, 18*b*, 18*c*, and/or the like) from the inlet. For example, an isolation valve 54 can comprise a quick-connect, quick-disconnect, and/or quick-release connector or coupler configured to automatically close an inlet upon decoupling of the fluid source from the inlet.

In the embodiment shown, manifold 10*a* is modular. For example, as shown, manifold 10*a* comprises three (3) subsea valve modules, 62*a*, 62*b*, and 62*c*, sometimes referred to collectively as "subsea valve modules 62." However, in other embodiments, the present manifolds can comprise any suitable number of subsea valve modules, such as, for example, a number greater than any one of, or between any two of: 1, 2, 3, 4, 5, 6, 7, 8, 9, 10, 15, 20, 25, 30, 35, 40, 45, 50, 55, 60, 65, 70, or more, subsea valve modules. In some embodiments, the present manifolds may not be modular insofar as the manifolds do not comprise removable subsea valve modules (e.g., but may otherwise comprise any and/or all of the features described with respect to manifold 10*a*). In some embodiments, a single subsea valve module 62 alone can function as a manifold.

Referring additionally to FIGS. 5A-5H and 6, shown therein is one embodiment 62*a* of the present subsea valve modules. The following description of subsea valve module 62*a* is provided by way of example, and other subsea valve modules 62 may or may not comprise any and/or all of the features described below with respect to subsea valve module 62*a*. In the embodiment shown, subsea valve module 62*a* comprises one or more inlets 14, each configured to receive hydraulic fluid from a fluid source (e.g., 18*a*). In this embodiment, subsea valve module 62*a* comprises at least two outlets 22 that, through operation of a valve assembly 42, are in simultaneous fluid communication with a same one of inlets 14. For example, as shown, valve assembly 42*a* is configured to allow outlets 22*a* and 22*e* to be in simultaneous fluid communication with inlet 14*a*. In this way, subsea valve module 66*a* is configured to be coupled in fluid communication with both a hydraulically actuated device (e.g., 30, via outlet 22*a*) and another subsea valve module (e.g., 62*b*, via outlet 22*e*).

By way of further example, in the embodiment shown, outlet 22*a* is configured to be in fluid communication with actuation port of hydraulically actuated device 30 (e.g., as described above for manifold 10*a*), and outlet 22*e* is configured to be in fluid communication with an outlet of a second subsea valve module (e.g., 62*b*). To illustrate, manifold 10*a* comprises first and second subsea valve modules, 62*a* and 62*b*, respectively where outlet 22*a* of first subsea valve module 62*a* is configured to be in simultaneous fluid communication with (e.g., via outlet 22*e*) an outlet 22*f* of second subsea valve module 62*b* and (e.g., via outlet 22*a*) an actuation port of the hydraulically actuated device.

As mentioned above, manifold 10*a* comprises a third subsea valve module 62*c*. In this embodiment, outlet 22*a* of first subsea valve module 62*a* is configured to be in simultaneous fluid communication with (e.g., via outlet 22*e*) at least one outlet 22*f* of second subsea valve module 62*b*, (e.g., via outlet 22*g* of second subsea valve module 62*b*) at least one outlet 22*h* of third subsea valve module 62*c*, and (e.g., via outlet 22*a*) an actuation port of hydraulically actuated device 30. In this and similar fashions, additional subsea valve modules can be added to manifold 10*a* (e.g., by placing an outlet 22 of an additional subsea valve module 62 in fluid communication with an outlet 22 of a subsea valve module 62 of manifold 10*a* and/or of manifold 10*a*). In some embodiments, any outlets 22 that are not used may be capped, sealed, and/or the like, or omitted. In some embodiments, any inlets 14 that are not used may be capped, sealed, and/or the like, or omitted.

In the embodiment shown, at least one subsea valve module 62 is configured to be coupled to at least one other subsea valve module. Subsea valve modules of the present disclose can be coupled to one another through any suitable structure, such as, for example, fasteners (e.g., nuts, bolts, rivets, and/or the like), interlocking features of the subsea valve modules, and/or the like. For example, in this embodiment, subsea valve modules (e.g., 62*a* and 62*b*, 62*b* and 62*c*, and/or the like) are coupled together directly via interlocking features of outlets 22. While in the following description, some subsea valve modules 62 are described as being directly coupled to one another, in other embodiments, subsea valve modules 62 can be coupled to one another in any suitable fashion (e.g., directly and/or indirectly), such as, for example, with hoses, tubes, conduits, and/or the like (e.g. whether rigid and/or flexible).

In the depicted embodiment, at least two of the subsea valve modules (e.g., 62*a* and 62*b*, 62*b* and 62*c*, and/or the like) define one or more conduits 66 (e.g., indicated in dashed lines in FIG. 1D) when the at least two of the subsea valve modules are coupled together. In the embodiment shown, conduit(s) 66 are configured to facilitate fluid communication with and between outlet(s) of the subsea valve modules that, when coupled to one another, define the conduit(s). For example, when subsea valve module 62*a* is coupled to subsea valve module 62*b*, the subsea valve modules define a conduit 66 in fluid communication with outlets 22*a*, 22*e*, 22*f*, and 22*g* (if present). In embodiments without removable subsea valve modules, conduit(s) 66 can nevertheless be defined by the manifold (e.g., and apart from not being defined by the coupling of two subsea valve modules, otherwise comprise the same or a similar structure).

Conduit(s) 66 can comprise any suitable shape, such as, for example, having circular, elliptical, and/or otherwise rounded cross-sections, triangular, square, and/or otherwise polygonal cross-sections, and/or the like. In this embodiment, conduit(s) 66 are each defined by substantially aligned passageways within the subsea valve modules, that when coupled to one another, define the conduit; however, in other embodiments, conduit(s) may be defined by passageways within the subsea valve modules that are misaligned, non-parallel, and/or the like. In this embodiment, each of conduit(s) 66 is configured to communicate hydraulic fluid to a respective actuation port of a hydraulically actuated device (e.g., 30).

In part due to the modular nature of manifold 10*a* and subsea valve modules 62*a*, 62*b* 62*c*, and/or the like, manifold 10*a* is configured to have redundancy (e.g., whether hydraulic redundancy, electric redundancy, and/or the like) added and/or removed. For example, in this embodiment, at least two of, and up to and including all of, subsea valve modules 62 are configured to receive hydraulic fluid from respective fluid sources (e.g., subsea valve module 62*a* from fluid source 18*a*, subsea valve module 62*b* from fluid source 18*b*, subsea valve module 62*c* from fluid source 18*c*, and/or the like). For example, some embodiments of the present methods for providing hydraulic fluid to a hydraulically actuated device (e.g., 30) of a blowout preventer comprise coupling a first outlet (e.g., 22*a*) of a first subsea valve module (e.g., 62*a*) to an actuation port of the hydraulically actuated device, and coupling a first outlet (e.g., 22*f*) of a second subsea valve module (e.g., 62*b*) to a second outlet (e.g., 22*e*) of the first subsea valve module, each subsea valve module having an inlet (e.g., inlet 14*a* of subsea valve module 62*a* and inlet 14*b* of subsea valve module 62*b*) configured to receive hydraulic fluid from a fluid source (e.g., 18*a*, 18*b*, 18*c*, and/or the like) and configured to allow simultaneous fluid communication between the inlet and each of the outlets. Some embodiments comprise coupling a first outlet (e.g., 22*h*) of a third subsea valve module (e.g., 62*c*) to a second outlet (e.g., 22*g*) of the second subsea valve module. Some embodiments comprise, for each subsea valve module, coupling a respective fluid source to the inlet (e.g., fluid source 18*a* coupled to inlet 14*a*, fluid source 18*b* coupled to inlet 14*b*, and fluid source 18*c* coupled to inlet 14*c*).

In the embodiment shown, manifold 10*a* and/or subsea valve modules 62*a*, 62*b*, and/or 62*c* are configured to be removable (e.g., whether in part or in whole) from the blowout preventer via manipulation by a remotely operated underwater vehicle (ROV). In some embodiments, a manifold (e.g., 10*a*) and/or a subsea valve module (e.g., 62*a*, 62*b*, 62*c*, and/or the like) comprises an ROV access device, such as, for example, a hydraulic connector (e.g., a stab and/or the like), an electrical connector (e.g., an inductive coupler, and/or the like), and/or an interface (e.g., a panel, and/or the like). In some embodiments, a manifold (e.g., 10*a*) and/or a subsea valve module (e.g., 62*a*, 62*b*, 62*c*, and/or the like) is configured to be removable from the blowout preventer via operation of a winch and/or the like.

In some embodiments, manifolds (e.g., 10*a*) and/or subsea valve modules (e.g., 62*a*, 62*b*, 62*c*, and/or the like) are configured as lowest replaceable units (LRUs). For example, in this embodiment, subsea valve modules 62*a*, 62*b*, and 62*c* are configured to be replaced rather than repaired. For example, in some embodiments, components of a subsea valve module, such as valves in a valve assembly 42, cannot be readily removed from the subsea valve module without damaging the components and/or the subsea valve module). In some embodiments, subsea valve modules 62 may comprise tamper evident features, such as, for example, tamper evident seals, locks, tags, paint, and/or the like.

While in this embodiment subsea valve modules 62*a*, 62*b*, and 62*c* are depicted as forming part of manifold 10*a*, in this and other embodiments, subsea valve modules and/or manifolds of the present disclosure can be (e.g., spatially) distributed across various locations on a blowout preventer stack (e.g., and each be in fluid communication with one or more of a plurality of hydraulically actuated devices of the blowout preventer stack). In this way, the present manifolds and/or subsea valve modules can control a multitude of functions, without the need for large multi-port stabs and related hoses and connections.

In the embodiment shown, manifold 10*a* comprises one or more electrical connectors 74, each in electrical communication with at least one valve assembly 42. Electrical connectors of the present manifolds and/or subsea valve modules can comprise any suitable connector (e.g., whether dry- and/or wet-mate). For example, in this embodiment, at least one electrical connector 74 comprises a wet-mate inductive coupler.

Electrical connectors 74 can be configured to electrically couple to any suitable structure, such as, for example, a tether, an auxiliary cable, and/or the like, whether provided from above-sea and/or coupled to another subsea component, such as a low marine riser package. In some embodiments, electrical connectors 74 can be configured to electrically couple to a rigid connector block coupled to a subsea structure (e.g., a low marine riser package and/or a blowout preventer) (e.g., without requiring a tether, auxiliary cable, and/or the like between the connector block and the connector). In this way, in some embodiments, the number of cables, tethers, conduits, and/or the like can be minimized, which may enhance reliability and/or fault tolerance.

In the embodiment shown, manifold 10*a* comprises a control circuit 78*a* configured to communicate power and/or control signals to and/or from at least one of valve assemblies 42. For example, in this embodiment, control circuit 78*a* is in electrical communication with and configured to communicate power and/or control signals through an electrical connector 74 (e.g., such that control circuit 78*a* can communicate power and/or control signals via a wired connection). Control circuits of the present manifolds and/or subsea valve modules can be configured to communicate power and/or control signals from any suitable component to any suitable component. For example, control circuit 78*a* of subsea valve module 62*a* is configured to: communicate power and/or control signals between components of subsea valve module 62*a*, such as, for example, valve assembly 42*a*, processor 86, and/or the like, between subsea valve module 62*a* and other manifolds and/or subsea valve modules and/or components thereof, between subsea valve module 62*a* and other components (e.g., blowout preventers, low marine riser packages, user interfaces, ROVs, and/or the like). Examples of control and/or power and/or data communication systems suitable for use with some embodiments of the present manifolds are disclosed in a co-pending U.S. patent application filed on the same day as the present application and entitled "BLOWOUT PREVENTER CONTROL AND/OR POWER AND/OR DATA COMMUNICATION SYSTEMS AND RELATED METHODS," which is hereby incorporated by reference in its entirety.

In some embodiments, at least a portion of control circuit 78*a* is disposed within a housing 82. In this embodiment, housing 82 comprises an atmospheric pressure vessel (e.g., is configured to have an internal pressure of approximately one (1) atmosphere (atm)). In this way, housing 82 can function to protect at least a portion of control circuit 78*a* and/or other components that may be negatively impacted by the subsea environment from the subsea environment (e.g., pilot stage valves 58, processor 86, memory 90 and/or the like) (e.g., housing 82 is configured to withstand ambient pressures of up to, or larger than, 5,000 psig). In some embodiments, housing 82 or a portion thereof can be fluid-filled (e.g., filled with a non-conductive substance, such as, for example, a dielectric substance, and/or the like). In some embodiments, housing 82 (or a portion thereof) may be pressure-compensated, for example, having an internal pressure equal to or greater than a pressure within a subsea environment (e.g., from 5 to 7 psig greater).

In the embodiment shown, manifold 10*a* comprises a processor 86 configured to control and/or monitor actuation of a valve assembly 42 (described in more detail below). In some embodiments, processor 86 is (e.g., additionally) configured to communicate with components external to the manifold and/or subsea valve module comprising the processor. For example, in some embodiments, processor 86 is configured to transmit and/or receive commands and/or information to and/or from a user interface, blowout preventer, low marine riser package, ROV, an external manifold and/or subsea valve module, and/or the like. By way of illustration, processor 86 can receive a command from a user interface to, for example, reduce the amount of current applied to an electrically actuated pilot valve 58 (e.g., as part of a peak-and-hold methodology), to actuate one or more isolation valves 54, and/or the like, and/or the like.

Information transmitted and/or received by processor 86 can include, but is not limited to including, environmental information (e.g., pressure, temperature, and/or the like, whether within the manifold and/or subsea valve module comprising the processor and/or within another manifold and/or subsea valve module, within a subsea environment, within an above-sea environment, and/or the like, which may or may not be captured by sensors 94), information regarding the state of components (e.g., valves, hydraulically actuated devices, and/or the like) (e.g., open, closed, functioning, malfunctioning, and/or the like), and/or the like.

In some embodiments, commands and/or information may be packaged and/or unpackaged by the processor (e.g., information and/or commands packaged into metadata and/or metadata unpackaged into information and/or commands) (e.g., descriptive metadata). In this way, processor 86 can send and/or receive commands and/or information while minimizing the impact of such communications on control circuit 78*a*, an external network, and/or the like (e.g., by reducing the required bandwidth for such communications). However, in other embodiments, processor 86 may send and/or receive at least a portion of the commands and/or information in an unpackaged format (e.g., as raw data).

In some embodiments, commands and/or information may be transmitted to and/or from processor 86 in real-time. In some embodiments, commands and/or information may be transmitted to and/or from processor 86 periodically (e.g., at time intervals which may be pre-determined, between which processor 86 may be configured to store information and/or commands in a memory 90, described in more detail below).

As mentioned above, in the embodiment shown, processor 86 is configured to control actuation of a valve assembly 42. Such control can be open-loop (e.g., executing received commands and/or commands stored within memory 90, described in more detail below) and/or closed-loop (e.g., controlling actuation of a valve assembly 42 based, at least in part, on data received from sensors 94, described in more detail below).

For example, in this embodiment, manifold 10*a* comprises one or more sensors 94 configured to capture data indicative of at least one of hydraulic fluid pressure, temperature, flow rate, and/or the like. Sensors of the present manifolds can comprise any suitable sensor, such as, for example, temperature sensors (thermocouples, resistance temperature detectors (RTDs), and/or the like), pressure sensors (e.g., piezoelectric pressure sensors, strain gauges, and/or the like), position sensors (e.g., Hall effect sensors, linear variable differential transformers, potentiometers, and/or the like), velocity sensors (e.g., observation-based sensors, accelerometer-based sensors, and/or the like), acceleration sensors, flow sensors, current sensors, and/or the like, whether external and/or internal to the processor, subsea valve module, manifold, and/or the like, and whether virtual and/or physical.

In the depicted embodiment, processor 86 is configured to control, based at least in part on the data captured by sensors 94, actuation of a valve assembly 42 (e.g., whether a valve assembly of the subsea valve module comprising the processor and/or a valve assembly of another subsea valve module). In this way manifold 10*a* can function, at least in part, autonomously, which may improve reliability, availability, fault tolerance, and/or the like.

To illustrate, some of the present methods for controlling hydraulic fluid flow between a hydraulically actuated device (e.g., 30) of a blowout preventer and a fluid source (e.g., 18*a*, 18*b*, 18*c*, and/or the like) comprise monitoring, with a processor (e.g., 86), a first data set indicative of flow rate through an inlet (e.g., 14) of a manifold, the first data set captured by a first sensor (e.g., 94), the manifold in fluid communication with and between the fluid source and the hydraulically actuated device, monitoring, with the processor, a second data set indicative of flow rate through an outlet (e.g., 22) of the manifold, the second data set captured by a second sensor (e.g., 94), comparing, with the processor, the first data set and the second data set to determine an amount of hydraulic fluid loss within the manifold, and actuating an isolation valve (e.g., 54) of the manifold to block fluid communication through at least a portion of the manifold if the amount of hydraulic fluid loss exceeds a threshold.

In the embodiment shown, control and/or processing algorithms, including those described above, can be stored in memory 90 (e.g., as code and/or instructions). Memories of the present manifolds and/or subsea valve modules can comprise any suitable memory, such as, for example, random-access memory (RAM), electrically erasable programmable read-only memory (EEPROM), read-only memory (ROM), hard disk drives (HDDs), solid state drives (SSDs), flash memory, and/or the like.

Figure 7:
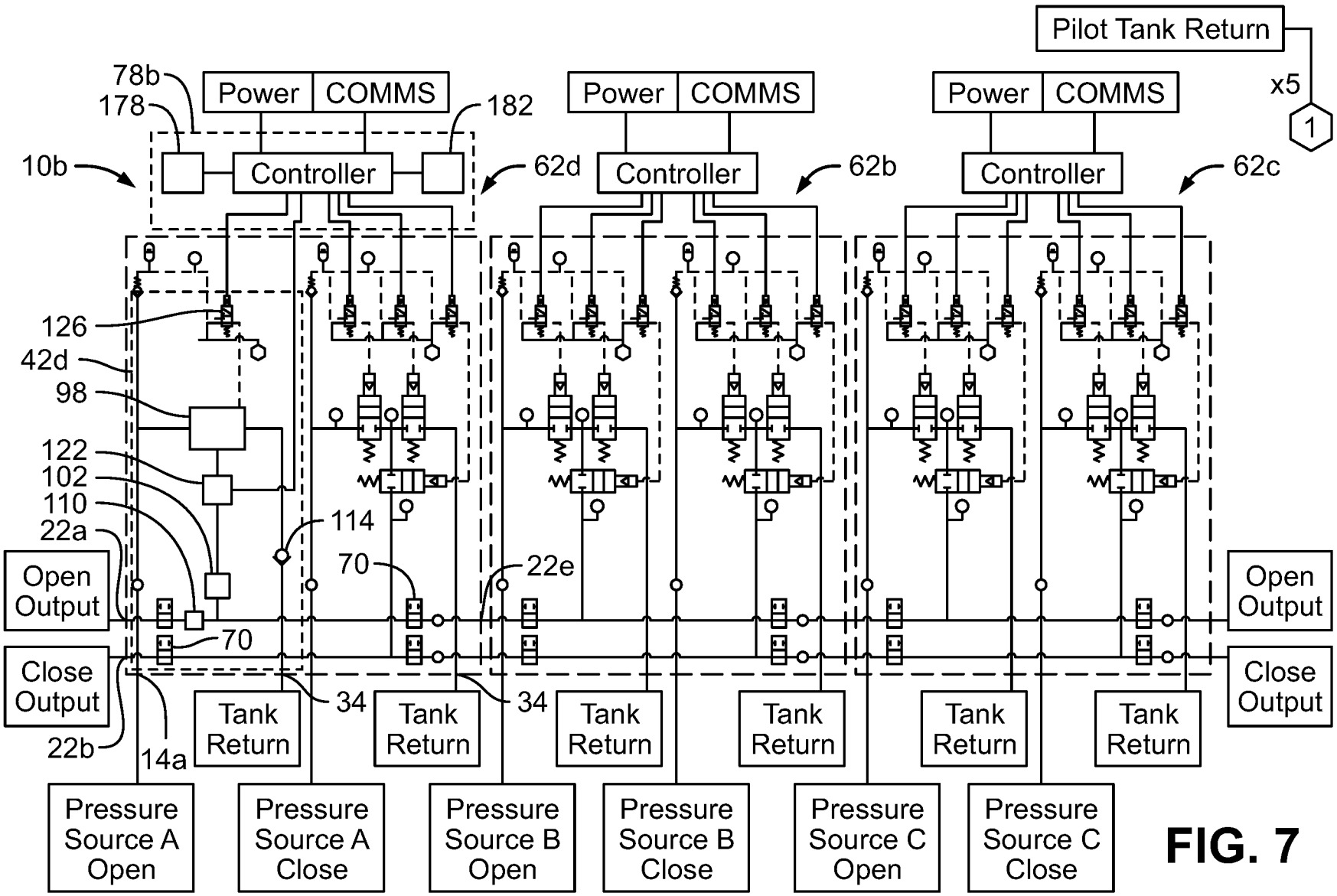
FIG. 7 is a diagram of a second embodiment of the present manifolds.

FIG. 7 depicts a diagram of a second embodiment 10*b* of the present manifolds. Manifold 10*b* is substantially similar to manifold 10*a*, with the primary differences described below. For example, in this embodiment, a valve assembly (e.g., 42*d*) comprises a three-way valve 98 configured to selectively allow fluid communication from at least one of the inlets (e.g., 14*a*) to at least one of the outlets (e.g., 22*a*), and selectively divert hydraulic fluid from at least one of the outlets (e.g., 22*a*) to at least one of a reservoir and a subsea environment (e.g., via a vent 34).

In the embodiment shown, at least one of subsea valve modules 62 (e.g., 62*b*, 62*c*, 62*d*, and/or the like) comprises one or more isolation valves 70 configured to selectively block fluid communication through at least one of outlets 22 (e.g., similarly to as described above for isolation valves 54, with isolation valve(s) 70 of some embodiments possessing any and/or all of the features described above for isolation valves 54). For example, in this embodiment, valve assembly 42*d* of subsea valve module 62*d* comprises an isolation valve 70 configured to selectively block fluid communication through outlet 22*a*, and an isolation valve 70 configured to selectively block fluid communication through outlet 22*e*.

In the embodiment shown, at least one subsea valve module and/or manifold comprises an isolation valve (e.g., 70) configured to automatically block fluid communication through at least one outlet 22 upon decoupling of the subsea valve module and/or manifold from a hydraulically actuated device and/or upon decoupling of another subsea valve module from subsea valve module and/or manifold (e.g., decoupling 10*b* from 30, 62*b* from 62*d*, 62*c* from 62*b*, and/or the like) (e.g., via an isolation valve 70 comprising a quick-connect, quick-disconnect, and/or quick-release connector or coupler configured to automatically close an outlet 22, similarly to as described above for isolation valves 54). In this way, fluid communication of sea water into the manifold (e.g., and/or one or more subsea valve modules) and/or into the decoupled subsea valve module can be limited or prevented completely. In part due to such isolation valves, the present manifolds and/or subsea valve modules can be configured to be hot swappable (e.g., with components, such as subsea valve modules, added, removed, and/or replaced, without otherwise interrupting operation of hydraulically actuated device 30).

For example, some embodiments of the present methods for removing a subsea valve module (e.g., 62*b*) from a manifold (e.g., 10*b*), the manifold coupled to and in fluid communication with a hydraulically actuated device (e.g., 30) of a blowout preventer, and the subsea valve module coupled to and in fluid communication with the manifold, comprise decoupling the subsea valve module from the manifold and causing actuation of one or more isolation valves (e.g., 70) of the manifold and/or subsea valve module to block fluid communication of sea water into at least a portion of the manifold and/or subsea valve module (e.g., through outlet 22*e*). In some embodiments, at least one of the isolation valves actuates automatically upon decoupling of the subsea valve module from the manifold. In some embodiments, causing actuation of at least one of the isolation valves comprises communicating an electrical signal to the at least one isolation valve (e.g., whether a power and/or command signal, for example, via an electrical connector 74, through a control circuit 78*b*, from a processor 86, via a battery 178, and/or the like).

In this embodiment, a valve assembly 42 (e.g., 42*d*) comprises a regulator 102. Regulators of the present manifolds and/or subsea valve modules can comprise any suitable regulator, such as, for example, a shear-seal, multi-stage, proportional, and/or the like regulator.

As shown, in this embodiment, a valve assembly 42 (e.g., 42*d*) comprises one or more relief valves 110. In the depicted embodiment, relief valve(s) 110 are configured to relieve and/or prevent excessive pressure within a hydraulically actuated device 30, manifold 10*b*, a subsea valve module 62, a valve assembly 42 and/or the like (e.g., and may comprise a drain in fluid communication with a vent 34). In the embodiment shown, a valve assembly 42 (e.g., 42*d*) comprises one or more check valves 114. Such check valves can be configured to control (e.g., the directionality of) hydraulic fluid flow within a hydraulically actuated device 30, manifold 10*b*, a subsea valve module 62, a valve assembly 42, and/or the like.

In the embodiment shown, a valve assembly 42 (e.g., 42*d*) comprises at least one integrated valve 122 (e.g., which includes a pilot stage valve and a corresponding main stage valve). In some embodiments, integrated valves may be integrated in that the pilot stage valve comprises at least one component in common with the main stage valve (e.g., such that the pilot stage valve and the main stage valve are, at least in part, unitary, such as, for example, sharing a common housing). However, in other embodiments, a pilot stage valve and a corresponding main stage valve may be separate components, yet nevertheless integrated in that the pilot stage valve is directly coupled to the main stage valve (e.g., through fasteners, interlocking features of the pilot stage valve and the main stage valve, connectors, and/or the like). Integrated valve(s) 122 may reduce the amount of and/or eliminate tubing, conduits, piping, and/or the like which may otherwise be required between the pilot stage valve and the main stage valve. In this way, integrated valve(s) 122 may reduce the risk of leakage, as well as reduce overall complexity, space requirements, weight, and/or cost.

In the embodiment shown, at least one valve assembly 42 comprises a bi-stable valve 126 (e.g., a bi-stable, electrically actuated pilot stage valve 126). Bi-stable valves of the present manifolds may be bi-stable in that they are configured to remain in one of two stable states (e.g., open and closed) without consuming power. For example, bi-stable valve 126 is configured such that power input may cause the bi-stable valve to change between two states (e.g., from open to closed, from closed to open, and/or the like), but power input may not be required to maintain the valve in either state (e.g., opened or closed). In this way, bi-stable valves of the present manifolds may reduce operational power requirements.

Figure 8A:
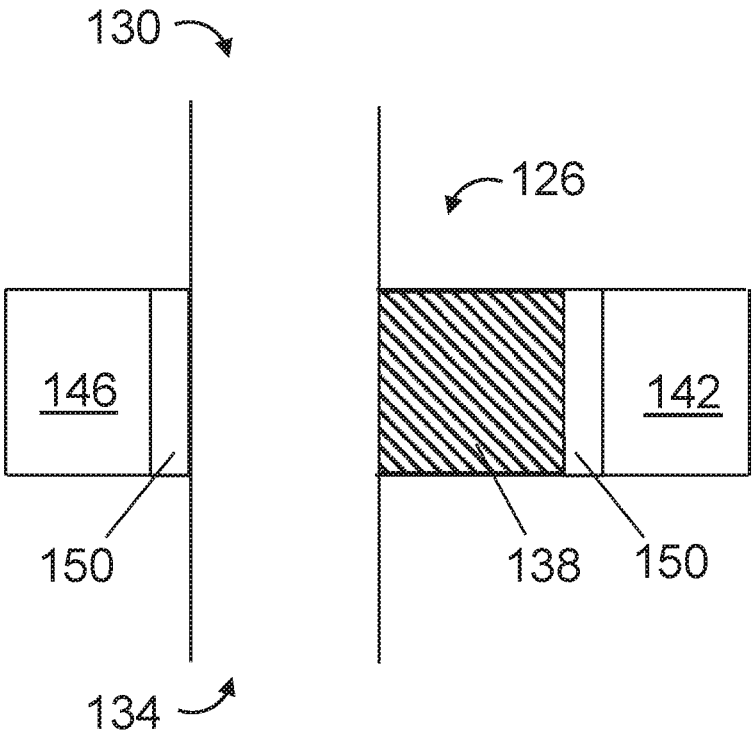
FIGS. 8A and 8B are diagrams of a bi-stable valve suitable for use in some embodiments of the present manifolds.
Figure 8B:
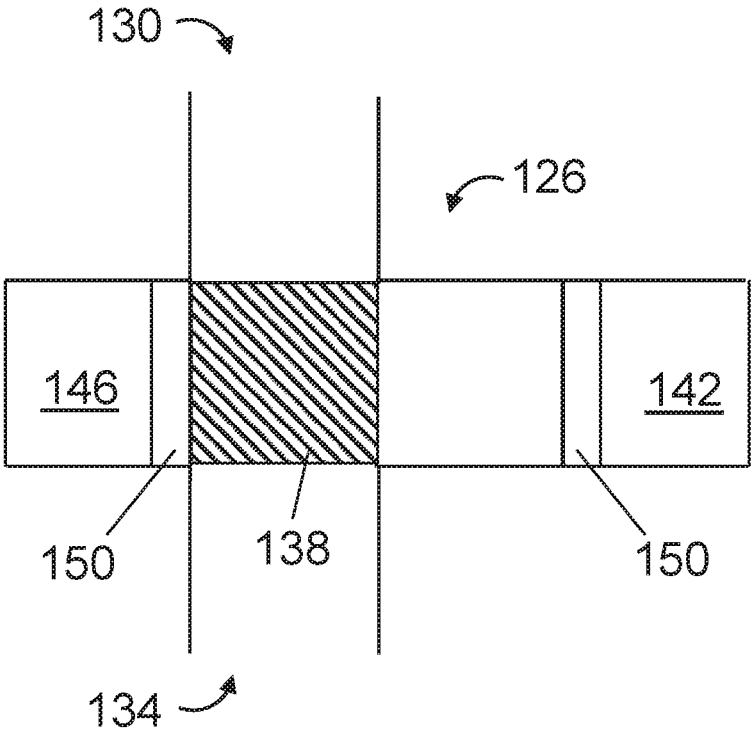

The following description of bi-stable valve 126 is provided by way of example, and not by way of limitation. As shown in FIGS. 8A and 8B, bi-stable valve 126 comprises an inlet 130, an outlet 134, and a ferromagnetic core 138 disposed between two or more electromagnets (e.g., in this embodiment two opposing solenoids or coils, 142 and 146). In the depicted embodiment, ferromagnetic core 138 is configured to control fluid communication from inlet 130 to outlet 134, depending on the position of the ferromagnetic core relative to the inlet and/or the outlet. For example, when ferromagnetic core 138 is in a first position (FIG. 8A), fluid communication between inlet 130 and outlet 134 is permitted, and when the ferromagnetic core is in a second position (FIG. 8B), fluid communication between inlet 130 and outlet 134 is blocked.

For example, during operation, solenoid or coil 142 may be powered (e.g., electrically), and a resulting magnetic field may cause ferromagnetic core 138 to be drawn towards solenoid or coil 142 such that valve 126 opens (FIG. 8A). By way of further example, solenoid or coil 146 may be powered (e.g., electrically) and a resulting magnetic field may cause ferromagnetic core 138 to be drawn towards solenoid or coil 146 such that valve 126 closes (FIG. 8B). In this embodiment, when solenoids or coils 142 and/or 146 are not powered, ferromagnetic core 138 may remain at rest (e.g., and be held in place by magnetism induced in the ferromagnetic core and/or nearest solenoid or coil). In some embodiments, one or more permanent magnets 150 may be configured to facilitate maintaining the ferromagnetic core in a given state (e.g., but exert a magnetic force on the ferromagnetic core that can be overcome by powering solenoid or coil 142 or 146).

Figure 9:
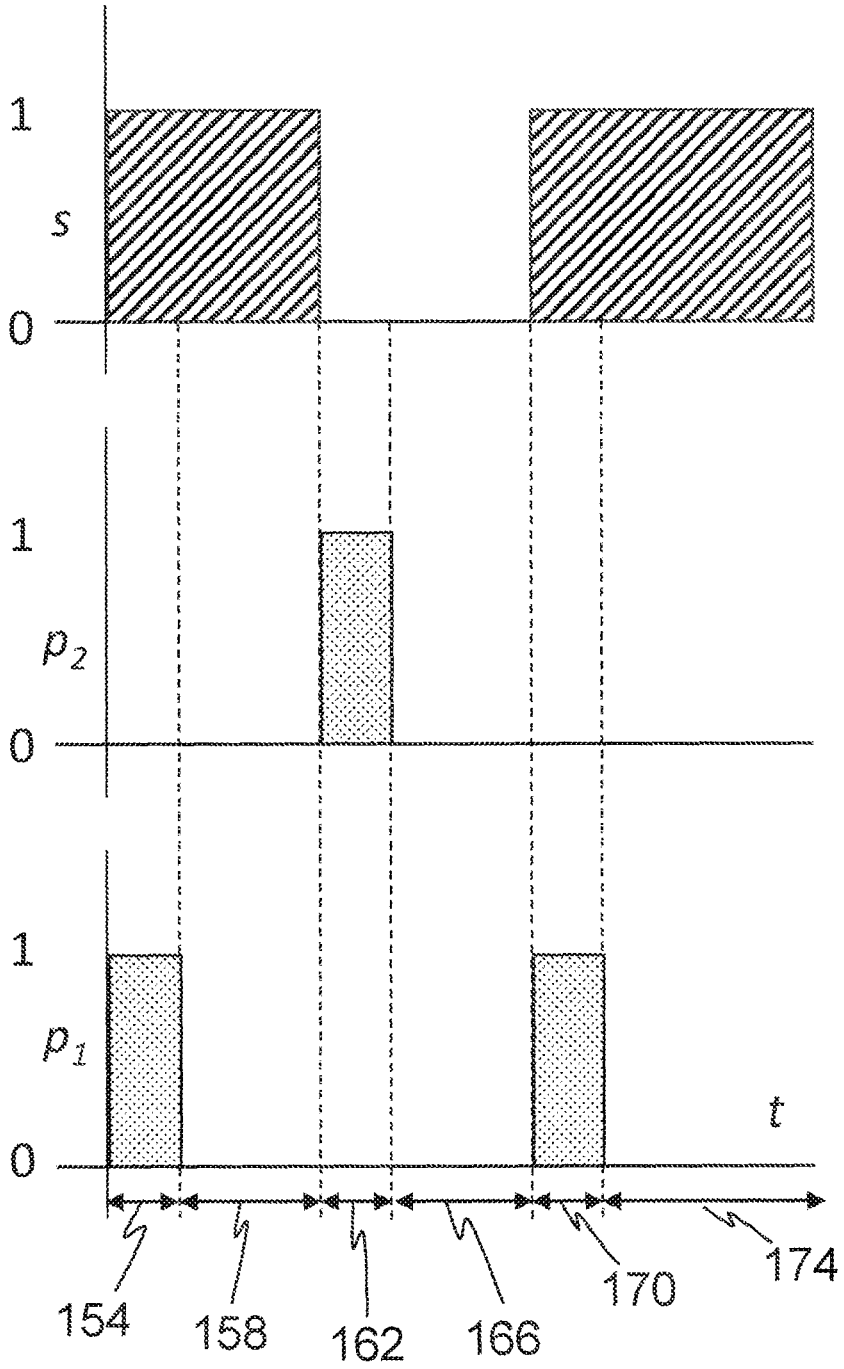
FIG. 9 is a diagram showing example actuations of the bi-stable valve of FIGS. 8A and 8B.

FIG. 9 depicts an example of bi-stable valve 126 state (open, 1, or closed, 0) versus power applied to each solenoid or coil 142 and 146 ($p_1$ and $p_2$, respectively, powered, 1, unpowered, 0) over time (t). As shown, during a first time interval 154, power ($p_1$) may be applied to solenoid or coil 142 to cause valve 126 to transition to an open state. During a second time interval 158, as shown, valve 126 remains in an open state, without application of power ($p_1$ and/or $p_2$) to either solenoid or coil 142 or solenoid or coil 146 (e.g., the valve remains in a first stable state). In this example, during a third time interval 162, power ($p_2$) may be applied to solenoid or coil 146 to cause valve 126 to transition to a closed state. During a fourth time interval 166, as shown, valve 126 remains in a closed state, without application of power ($p_1$ and/or $p_2$) to either solenoid or coil 142 or solenoid or coil 146 (e.g., the valve remains in a second stable state). Thus, application of power to either solenoid or coil 142 or solenoid or coil 146 may cause valve 126 to transition between open and closed states; however, application of power is not required to maintain the valve in a given state. For example, at a fifth time interval, 170, power ($p_1$) may be applied to solenoid or coil 142 to cause valve 126 to transition to the open state, and during a sixth time interval 174, valve 126 may remain in the open state, without application of power to either solenoid or coil 142 or solenoid or coil 146.

In the embodiment shown, manifold 10*b* comprises one or more batteries 178. Batteries of the present manifolds can comprise can comprise any suitable battery, such as, for example, lithium-ion, nickel-metal hydride, nickel-cadmium, lead-acid, and/or the like batteries. As shown, batteries 178 are in electrical communication with a valve assembly 42 (e.g., 42*d*). For example, batteries 178 can be configured to provide power to valve assembly 42*d* (e.g., to actuate main stage valves, pilot stage valves 58, isolation valves 70, and/or the like). In some embodiments, batteries 178 can be configured to provide power to a control circuit (e.g., 78*a*, 78*b*), processor(s) 86, memor(ies) 90, sensor(s) 94, other control components, and/or the like. In this way, some embodiments of the present manifolds and/or subsea valve modules can be configured to receive power from multiple (e.g., redundant) sources (e.g., power provided via an electrical connector 74 and power provided by a battery 178), which may enhance reliability and/or fault tolerance. In some embodiments, batteries 178 can be disposed within housing 82.

In the embodiment shown, control circuit 78*b* comprises a wireless receiver 182 configured to receive control signals (e.g., acoustic, optical, hydraulic, electromagnetic (e.g., radio), and/or the like control signals). In this embodiment, at least a portion of housing 82 comprises a composite material (e.g., reinforced plastic, ceramic composites, and/or the like). In this way, housing 82 can be configured to facilitate reception and/or transmission of control signals from control circuit 78*b*.

Some embodiments of the present manifolds comprise a comprise a plurality of manifolds and/or subsea valve modules (e.g., "a manifold assembly"). For example, in some embodiments, at least two manifolds and/or subsea valve modules of a manifold assembly are in electrical communication with one another via one or more dry-mate electrical connectors. In this way, some embodiments of the present manifold assemblies can minimize the number of required wet-mate electrical connectors. For example, a manifold assembly can be assembled above-sea and lowered to the blowout preventer, where a wet-mate connector of the manifold assembly can be placed into electrical communication with a power source, blowout preventer or component thereof, other component, and/or the like via the wet-mate connector.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

Alternative or Additional Descriptions of Illustrative Embodiments

The following alternative or additional descriptions of features of one or more embodiments of the present disclosure may be used, in part and/or in whole and in addition to and/or in lieu of, some of the descriptions provided above.

Some embodiments of the present apparatuses comprise a hydraulic device coupled to a blowout preventer located at a sea bed, where the hydraulic device is coupled to the blowout preventer at the sea bed, and a valve module that includes a first valve and a second valve, where the valve module is coupled at the sea bed to a hydraulic actuator of the hydraulic device and to the blowout preventer, in which the first valve controls the second valve and the second valve actuates the hydraulic actuator of the hydraulic device coupled to the blowout preventer.

In some embodiments, the first valve comprises at least one of an electrical valve, a hydraulic valve, and a pneumatic valve, and the second valve comprises at least one of a hydraulic and a pneumatic valve. In some embodiments, the first valve comprises an electrical solenoid and the electrical solenoid is actuated inductively. In some embodiments, the first valve is rigidly coupled to the second valve.

In some embodiments, the valve module is capable of being decoupled from the hydraulic actuator and the blowout preventer. In some embodiments, the valve module is capable of withstanding pressures in excess of 100 atmospheres. In some embodiments, the valve module comprises a pressure regulator valve for regulating pressure associated with the BOP.

In some embodiments, the hydraulic device comprises at least one of a ram, an annular, a connector, and a failsafe valve function.

Some embodiments of the present apparatuses comprise a hydraulic device coupled to a blowout preventer located at a sea bed, wherein the hydraulic device is coupled to the blowout preventer at the sea bed, a hydraulic valve having at least a first stable state and a second stable state, in which a first electrical current is applied to the hydraulic valve to transition a ferromagnetic core from the second state to the first state, and wherein upon ceasing application of the first electrical current to the hydraulic valve, the ferromagnetic core remains at the first state, wherein the hydraulic valve is coupled to a hydraulic actuator of the hydraulic device, and the hydraulic valve actuates the hydraulic actuator when the ferromagnetic core is at the first state.

In some embodiments, applying the first electrical current to the hydraulic valve comprises applying the first electrical current to a first solenoid of the hydraulic valve. In some embodiments, a second electrical current is applied to the hydraulic valve to transition the ferromagnetic core from the first state to the second state, wherein upon ceasing application of the second electrical current to the hydraulic valve, the ferromagnetic core remains at the second state. In some embodiments, applying the second current to the hydraulic valve comprises applying the second electrical current to a second solenoid of the hydraulic valve.

In some embodiments, the hydraulic device comprises at least one of a ram, an annular, a connector, and a failsafe valve function.

Some embodiments of the present apparatuses comprise a hydraulic device coupled to a blowout preventer located at a sea bed, where the hydraulic device is coupled to the blowout preventer at the sea bed, and a valve module comprising a hydraulic valve and a processor, in which the valve module is coupled at the sea bed to a hydraulic actuator of the hydraulic device and to the blowout preventer, wherein the hydraulic valve actuates the hydraulic actuator when actuated, and the processor is configured to at least one of: control the amount of current used to actuate the hydraulic valve, communicate with an external component or a user interface, measure the performance of the hydraulic valve or a component coupled to the hydraulic valve, and adjust the operation of the hydraulic valve based, at least in part, on the measured performance.

Some embodiments comprise a plurality of sensors coupled to at least one of the blowout preventer, the hydraulic device, the hydraulic actuator, and the hydraulic valve, wherein the plurality of sensors are configured to sense operation variations associated with the at least one of the blowout preventer, the hydraulic device, the hydraulic actuator, and the hydraulic valve and transmit information to the processor.

In some embodiments, the valve module comprises a pressure regulator valve for regulating pressure associated with the BOP. In some embodiments, the valve module is removable from the hydraulic actuator and the BOP. In some embodiments, the valve module is configured to withstand pressures in excess of 100 atmospheres.

In some embodiments, the hydraulic device comprises at least one of a ram, an annular, a connector, and a failsafe valve function.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A manifold system for providing hydraulic fluid to a first hydraulically actuated device and a second hydraulically actuated device of a blowout preventer, the manifold system comprising:

a first fluid source and a second fluid source separate from the first fluid source such that the first fluid source and the second fluid source may be activated and deactivated independently;

a plurality of inlets configured to receive hydraulic fluid from the first fluid source and the second fluid source;

a first outlet in fluid communication with an actuation port of the first hydraulically actuated device;

a second outlet in fluid communication with an actuation port of the second hydraulically actuated device;

a first subsea valve assembly, the first subsea valve assembly having a main stage valve configured to control hydraulic fluid communication from at least one of the inlets to at the first outlet; and a second subsea valve assembly, the second subsea valve assembly having a main stage valve configured to control hydraulic fluid communication from at least one of the inlets to the second outlet.

2. The manifold system of claim 1, wherein:

the first subsea valve assembly further comprises a first pilot valve configured to actuate the main first main stage valve.

3. The manifold system of claim 2, wherein the first pilot valve is actuated by an electrical solenoid.

4. The manifold system of claim 1, wherein the manifold lacks a shuttle valve controlling fluid from the first fluid source and the second fluid source.

5. A manifold system for providing hydraulic fluid to a hydraulically actuated device of a blowout preventer, the manifold system comprising:

a first fluid source and a second fluid source separate from the first fluid source such that the first fluid source and the second fluid source may be activated and deactivated independently;

a first subsea valve module comprising:

an inlet configured to receive hydraulic fluid from the first fluid source and the second fluid source;

an outlet, the first subsea valve module configured to allow the outlet to be in fluid communication with the inlet; and one or more subsea valve assemblies, each configured to control hydraulic fluid communication from the inlet to the outlet;

a second subsea valve module comprising:

an inlet configured to receive hydraulic fluid from the first fluid source and the second fluid source;

an outlet, the second subsea valve module configured to allow the outlet to be in fluid communication with the inlet; and one or more subsea valve assemblies, each configured to control hydraulic fluid communication from the inlet to the outlet;

wherein the outlet of the first subsea valve module is configured to be in fluid communication with an actuation port of a first hydraulically actuated device, and the outlet of the second subsea valve module is configured to be in fluid communication with an actuation port of a second hydraulically actuated device.

6. The manifold system of claim 5, wherein:

the first subsea valve assembly further comprises a first pilot valve configured to actuate the main first main stage valve.

7. The manifold system of claim 6, wherein the first pilot valve is actuated by an electrical solenoid.

8. The manifold system of claim 5, wherein the manifold lacks a shuttle valve controlling fluid from the first fluid source and the second fluid source.

9. A method for providing hydraulic fluid to a first hydraulically actuated device and a second hydraulically actuated device of a blowout preventer, the method comprising:

coupling at least a first fluid source and a second fluid source into fluid communication with an actuation port of the first hydraulically actuated device and an actuation port of the second hydraulically actuated device, the second fluid source being separate from the first fluid source such that the first fluid source and the second fluid source may be activated and deactivated independently;

coupling the first fluid source and the second fluid source to an inlet of a manifold;

coupling a first subsea valve module to the inlet of the manifold, the first subsea valve module comprising:

a first inlet configured to receive hydraulic fluid from the inlet of the manifold;

a first outlet, the first subsea valve module configured to allow the first outlet to be in fluid communication with the first inlet; and a subsea valve assembly each configured to control hydraulic fluid communication from the first inlet to the first outlet;

coupling a second subsea valve module to the inlet of the manifold, the second subsea module comprising:

a second inlet configured to receive hydraulic fluid from inlet of the manifold;

a second outlet, the second subsea valve module configured to allow the second outlet to be in fluid communication with the second inlet; and a subsea valve assembly each configured to control hydraulic fluid communication from the first inlet to the first outlet;

coupling the outlet of the first subsea valve module in fluid communication with the actuation port of the first hydraulically actuated device; and coupling the outlet of the second subsea valve module in fluid communication with the actuation port of the second hydraulically actuated device.

10. The method of claim 9, further comprising providing hydraulic fluid simultaneously from the first fluid source and the second fluid source to the actuation port of the first hydraulically actuated device.

11. The method of claim 9, further comprising providing hydraulic fluid to the actuation port of the first hydraulically actuated device from the first fluid source;

measuring at least one of a pressure or a flow rate of hydraulic fluid provided to the actuation port of the first hydraulically actuated device.

12. The method of claim 11, further comprising providing hydraulic fluid to the actuation port of the first hydraulically actuated device;

evaluating sufficiency of the pressure or the flow rate of hydraulic fluid provided to the actuation port of the first hydraulically actuated device and, upon filing the pressure or the flow rate of hydraulic fluid provided to the actuation port of the first hydraulically actuated device to be insufficient, providing hydraulic fluid to the actuation port of the first hydraulically actuated device from the second fluid source.

* * * * *